US012428821B2

(12) United States Patent
Ishihara et al.

(10) Patent No.: US 12,428,821 B2
(45) Date of Patent: Sep. 30, 2025

(54) CONSTRUCTION MACHINE

(71) Applicant: HITACHI CONSTRUCTION MACHINERY CO., LTD., Tokyo (JP)

(72) Inventors: Shinji Ishihara, Tokyo (JP); Shiho Izumi, Tsuchiura (JP); Yasuhiko Kanari, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 355 days.

(21) Appl. No.: 18/024,098

(22) PCT Filed: Oct. 19, 2021

(86) PCT No.: PCT/JP2021/038634
§ 371 (c)(1),
(2) Date: Nov. 7, 2023

(87) PCT Pub. No.: WO2022/085688
PCT Pub. Date: Apr. 28, 2022

(65) Prior Publication Data

US 2024/0102266 A1 Mar. 28, 2024

(30) Foreign Application Priority Data

Oct. 20, 2020 (JP) ..... 2020-175824

(51) Int. Cl.
*E02F 9/26* (2006.01)
*E02F 3/43* (2006.01)

(52) U.S. Cl.
CPC ..... *E02F 9/265* (2013.01); *E02F 3/43* (2013.01)

(58) Field of Classification Search
CPC ... E02F 3/43; E02F 3/437; E02F 9/265; E02F 9/268
See application file for complete search history.

(56) References Cited

U.S. PATENT DOCUMENTS 9,551,130 B2 * 1/2017 Hendron ..... E02F 3/7631
9,598,845 B2 * 3/2017 Baba ..... E02F 9/2033
(Continued)

FOREIGN PATENT DOCUMENTS

CN 105517645 A 4/2016
JP 2018-145753 A 9/2018
(Continued)

OTHER PUBLICATIONS

International Preliminary Report on Patentability received in corresponding International Application No. PCT/JP2021/038634 dated May 4, 2023.
(Continued)

*Primary Examiner* — Tyler J Lee
(74) *Attorney, Agent, or Firm* — Mattingly & Malur, PC

(57) ABSTRACT

A construction machine includes an angle measuring apparatus that sense acceleration and angular velocities of installation portions on a machine body and a work implement and that compute angles of the installation portions relative to a reference plane based on sensing results, and a controller that executes operation assistance of a work implement based on postural information on the machine body and the work implement computed on the basis of the angles from the angle measuring apparatus. The controller computes second required accuracy of angle computation by the angle measuring apparatus on the basis of first required accuracy set for the operation assistance, determines whether the state of the machine body has changed from an active state to a stopped state on the basis of the sensing results of the angle measuring apparatus, determines whether the computation accuracy of the angle measuring apparatus satisfies the second required accuracy, and stops the operation assistance of the work implement or gives a warning in a case where the state of the machine body has changed to a stopped state,
(Continued)

and where the computation accuracy fails to satisfy the second required accuracy.

7 Claims, 22 Drawing Sheets

(56) References Cited

U.S. PATENT DOCUMENTS

| | | | | |
|---|---|---|---|---|
| 9,739,038 | B2 * | 8/2017 | Baba | E02F 9/262 |
| 10,459,462 | B2 * | 10/2019 | Beschorner | G01S 17/86 |
| 10,968,607 | B2 * | 4/2021 | Iwamura | E02F 9/2004 |
| 11,668,077 | B2 * | 6/2023 | Sawodny | E02F 1/00 37/348 |
| 2008/0263908 | A1 * | 10/2008 | Schoenmaker | E02F 9/2041 711/100 |
| 2016/0168822 | A1 * | 6/2016 | White | E02F 9/2285 701/50 |
| 2016/0230366 | A1 * | 8/2016 | Hendron | E02F 3/7631 |
| 2016/0237655 | A1 * | 8/2016 | Baba | E02F 9/2037 |
| 2016/0244949 | A1 | 8/2016 | Kanemitsu | |
| 2016/0251836 | A1 * | 9/2016 | Baba | E02F 9/265 701/50 |
| 2016/0348343 | A1 | 12/2016 | Kanemitsu et al. | |
| 2018/0171598 | A1 * | 6/2018 | Iwamura | E02F 3/435 |
| 2020/0232188 | A1 | 7/2020 | Chiba et al. | |

FOREIGN PATENT DOCUMENTS

| | | | |
|---|---|---|---|
| JP | 2018-193704 | A | 12/2018 |
| WO | 2015-167022 | A1 | 11/2015 |
| WO | 2019-053833 | A1 | 3/2019 |

OTHER PUBLICATIONS

International Search Report of PCT/JP2021/038634 dated Dec. 28, 2021.

Chinese Office Action received in corresponding Chinese Application No. 202180053562.0 dated Apr. 17, 2024.

* cited by examiner

CONSTRUCTION MACHINE

TECHNICAL FIELD

The present invention relates to a construction machine including a work implement whose position and posture change, and in particular, relates to a construction machine that performs operation assistance of an operator based on various types of information including angular information output from measuring devices attached to the work implement and the like.

BACKGROUND ART

In recent years, in the field of construction machines such as hydraulic excavators, introduction of intelligent construction has been promoted to realize rationalization of construction by making efficient use of diverse information by applying information communication technologies to construction work. For example, there are construction machines having functionalities to assist operation by an operator such as machine guidance in which the position and posture of an articulated-type work implement formed by coupling a plurality of members such as a boom, an arm, and a bucket are displayed to the operator, or machine control in which the work implement is controlled in such a manner that it moves along a target construction surface.

The type of construction that uses the coordinates of a subject machine at a construction site when operation assistance such as machine guidance or machine control is performed is called three-dimensional intelligent construction (hereinafter referred to as 3D intelligent construction). A construction machine that supports 3D intelligent construction includes a satellite positioning system (Global Navigation Satellite System: GNSS) for acquiring the position of the subject machine. The GNSS measures the three-dimensional position (the latitude, longitude, and altitude) of the subject machine by receiving positioning signals from a plurality of satellites. For a construction machine like a hydraulic excavator including a work implement, not only the position of the subject machine, but also the orientation (azimuth) of the work implement is necessary for operation assistance. Accordingly, there is a known construction machine that has mounted thereon two GNSS antennas that receive positioning signals, and identifies the azimuth of a work implement on the basis of the positioning signals received by them.

Since various types of information for moves of the claw tip (tip position) of a bucket (work tool) along a construction-target surface are presented to an operator in machine guidance, not only positional information on the subject machine, but also postural information on the work implement is important. In view of this, a boom, an arm, and the bucket included in the work implement have attached thereto respective sensors for acquiring angles. As the sensors, inertial measurement units (IMUs) are often chosen from the perspective of attachability and responsiveness.

In machine guidance, as mentioned above, a GNSS and IMUs are used in combination to calculate the position and posture of a hydraulic excavator, and these pieces of information are presented to an operator. Accordingly, in a case where information on positions acquired from the GNSS and on angles acquired from the IMUs is different from actual information, inaccurate information is presented to the operator. If the operator continues excavation work on the basis of the inaccurate information, this causes a concern that construction needs to be redone since a ground is excavated excessively relative to a target construction surface undesirably or the excavation amount is insufficient, for example.

As a technology to cope with such problems, a technology described in Patent Document 1 is known. In order to control a work implement (work device) in a precise and continuous manner and/or display proper information on a work guidance screen during execution of intelligent construction, a work machine described in Patent Document 1 includes a position sensor that senses the position of the subject machine (work machine) by using a GNSS, and a state sensor (IMU) that senses action information representing an action of the work machine, and selects positional information used for generation of positional data of the work device according to the state of positioning by the position sensor and the action state of the work machine. Specifically, in a case where positioning by the position sensor is normal (in a case of a first mode), information on the position sensed by the position sensor is used as the positional information; on the other hand, in a case where the positioning is anomalous, and besides, where the work machine is in a stationary state (in a case of a second mode), information on a position determined by using both a particular point serving as a reference point of the work machine that has been set before the positioning becomes anomalous and the action information sensed by the state sensor (IMU) is used as the positional information. Note that, in a case where the positioning is anomalous, and besides, where the work machine is in a non-stationary state (in a case of a third mode), positional information is not provided.

PRIOR ART DOCUMENT

Patent Document

Patent Document 1: WO 2015/167022 A1

SUMMARY OF THE INVENTION

Problem to be Solved by the Invention

For operation assistance (machine guidance), the technology described in Patent Document 1 uses the positional information of the work machine used for generation of data of the position of the work device (e.g., the blade tip position of a bucket), only in a case where the positional information is accurate. However, also in the technology described in Patent Document 1, generation of the data of the position of the work device (the blade tip position of the bucket) requires angular information on the work machine in addition to the positional information on the work machine. Accordingly, in a case where the angular information on the work machine is inaccurate, it is difficult to accurately calculate the blade tip position of the bucket even if the positional information on the work machine mentioned above is accurate.

Meanwhile, as mentioned before, IMUs are used as sensors to acquire angular information on a construction machine in some cases. Each IMU is a device including two sensors which are an acceleration sensor and an angular velocity sensor, and also has an angle computation functionality of computing an angle by using acceleration sensed by the acceleration sensor and an angular velocity sensed by the angular velocity sensor. The IMU computes an angle by using the following two computation methods selectively or in combination. A first method is to calculate an angle relative to a reference plane (e.g., a horizontal plane) by comparing acceleration and gravitational acceleration sensed by the acceleration sensor. A second method is to calculate an angle by integrating angular velocities sensed by the angular velocity sensor. It should be noted that the second method can calculate only an angular change relative to, as the start point, a certain angle that is measured when the construction machine is in a stationary state. Because of this, it is possible that the first computation method that can calculate any angle at a time when the construction machine is stationary is used mainly.

However, since the first computation method uses gravitational acceleration as a reference value, it is sometimes not possible to accurately calculate an angle if acceleration other than the gravitational acceleration is generated. Translational acceleration is generated to a construction machine due to the start or stop of a traveling action or the like, and also centrifugal acceleration is generated to the construction machine due to a swinging action. If the first computation method is used in such a situation, the computation accuracy of the method deteriorates since the condition "acceleration sensed when the construction machine is stationary is compared with gravitational acceleration" does not hold true. Because of this, there is known a technology of IMU angle computation in which two computation results by the first and second computation methods are integrated by the Kalman filter, a complementation filter, or the like to thereby inhibit accuracy deterioration of computation results. However, it is extremely difficult to negate the accuracy deterioration of IMU angle computation even if such a technology is used.

The accuracy deterioration of IMU angle computation is explained below specifically. When a construction machine starts a traveling action from a stopped state, acceleration is generated to the machine body, and so resultant acceleration sensed by IMUs does not match gravitational acceleration. In this case, the first method cannot be used as IMU angle computation, and so the computation method switches from the first method to the second method at an appropriate timing after the start of the traveling action. The second computation method is continuously used during traveling since vibrations are generated to the machine body and acceleration is generated to the machine body even in a case where the traveling speed is constant. Because of this, angle computation is performed by serially integrating angular velocities sensed by angular velocity sensors while the traveling is continued, and so the influence of biases of the angular velocity sensors is accumulated by the integration computation to gradually increase computation errors undesirably. If the construction machine having been in the traveling state stops completely thereafter, the method of IMU angle computation switches from the second method to the first method at an appropriate timing after the stop. Even if the computation method switches from the second method to the first method, the continuity of computation results is ensured by performing a process such as interpolation or filtering on computation results by the second method and computation results by the first method. Hence, even when the construction machine stops completely and the method of IMU angle computation switches to the first method, errors resulting from the second computation method remain in angular information output from the IMUs for a while after complete stop of the construction machine, and so IMU computation errors cannot decrease immediately.

If machine guidance is executed by using, as a factor for decision making, only information that a traveling action is not being performed, without taking into consideration the errors in IMU computation results mentioned above, operation assistance is performed based on the inaccurate postural information including the IMU computation errors. So, there is a concern that a construction surface is damaged undesirably. Accordingly, in construction machines, it is necessary to take into consideration the fact that the accuracy of angle computation by IMUs deteriorates in some cases for a predetermined period after transition from a traveling or swinging action state to a stopped state even if the construction machine is in a stopped state.

The present invention has been made on the basis of the matters described above, and an object thereof is to provide a construction machine that allows inhibition of use of inaccurate postural information in operation assistance of a work implement such as machine guidance or machine control.

Means for Solving the Problem

The present application includes a plurality of means for solving the problem described above. An example thereof is a construction machine including a machine body, a work implement attached pivotably to the machine body, an angle measuring apparatus that is installed on the machine body and the work implement and is configured to sense acceleration and an angular velocity of an installation portion and perform angle computation of computing an angle of the installation portion relative to a reference plane on the basis of sensing results, and a controller configured to compute postural information representing postures of the machine body and the work implement based on the angle computed by the angle measuring apparatus, cause a display device to display the computed postural information, and execute operation assistance of the work implement based on the computed postural information. The controller is configured to perform required accuracy computation of computing second required accuracy that is accuracy required for the angle computation by the angle measuring apparatus, on the basis of first required accuracy that is required accuracy set for information used for the operation assistance of the work implement, make an action stop determination of determining whether or not a state of the machine body has changed from an active state to a stopped state, on the basis of the sensing results of the angle measuring apparatus, make an accuracy determination of determining whether or not accuracy of the angle computation by the angle measuring apparatus satisfies the second required accuracy, and stop the operation assistance of the work implement or give a warning in a case where it is determined that the state of the machine body has changed from an active state to a stopped state, and where it is determined that the accuracy of the angle computation by the angle measuring apparatus fails to satisfy the second required accuracy.

Advantages of the Invention

According to the present invention, the controller stops the operation assistance of the work implement such as machine guidance or machine control or gives a warning in a case where the accuracy of angle computation by the angle measuring apparatus fails to satisfy the required accuracy even if the machine body is in a stopped state, and so it is possible to inhibit use of inaccurate postural information during execution of the operation assistance of the work implement.

Problems, configurations, and advantages other than those described above are made clear by the following explanation of embodiments.

MODES FOR CARRYING OUT THE INVENTION

Construction machines according to embodiments of the present invention are explained below by using the figures. A hydraulic excavator is taken as an example of construction machines in the explanation of the present embodiments.

First Embodiment

Figure 1:
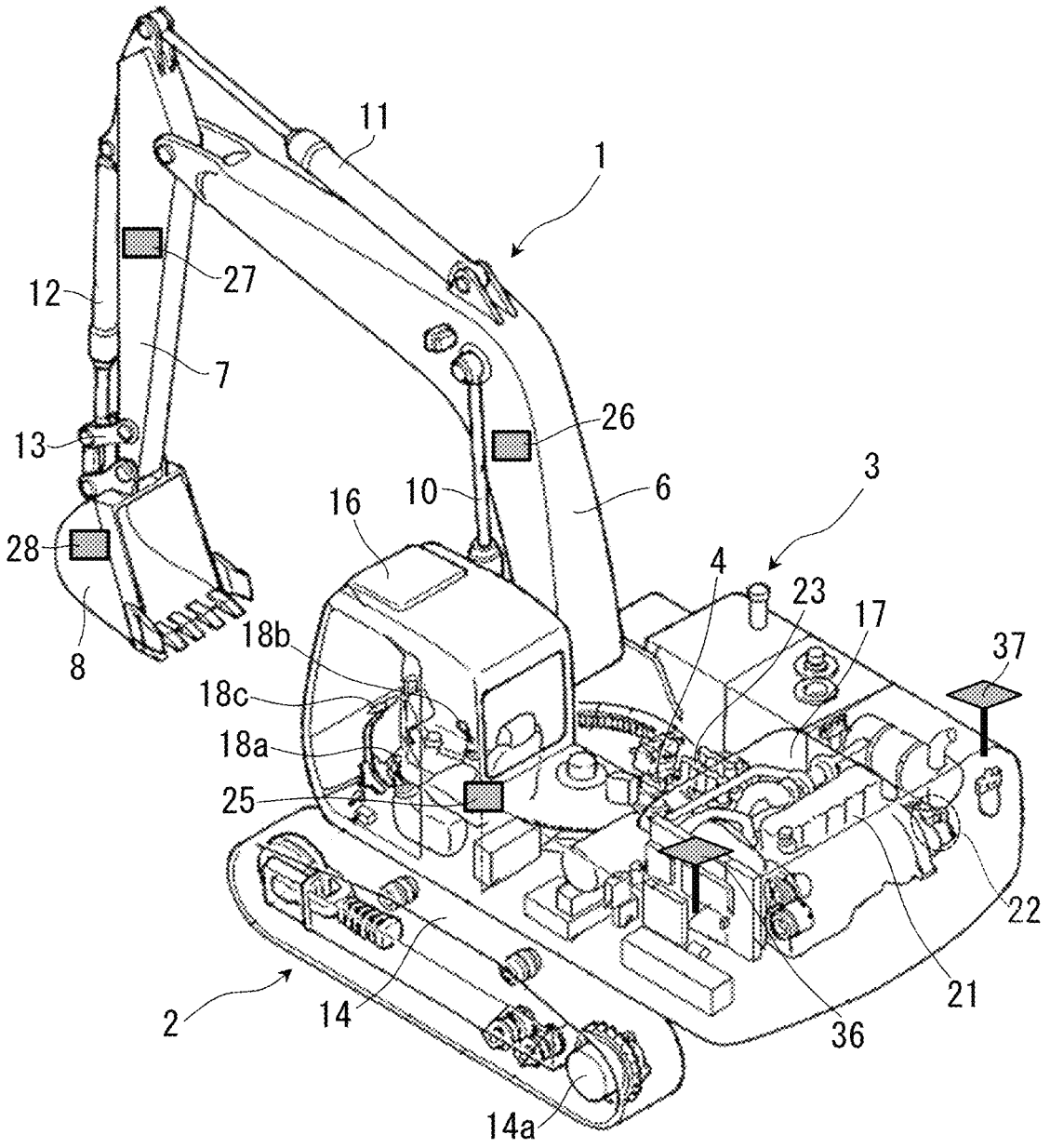
FIG. 1 is a perspective view depicting a hydraulic excavator to which a construction machine according to a first embodiment of the present invention is applied.
Figure 2:
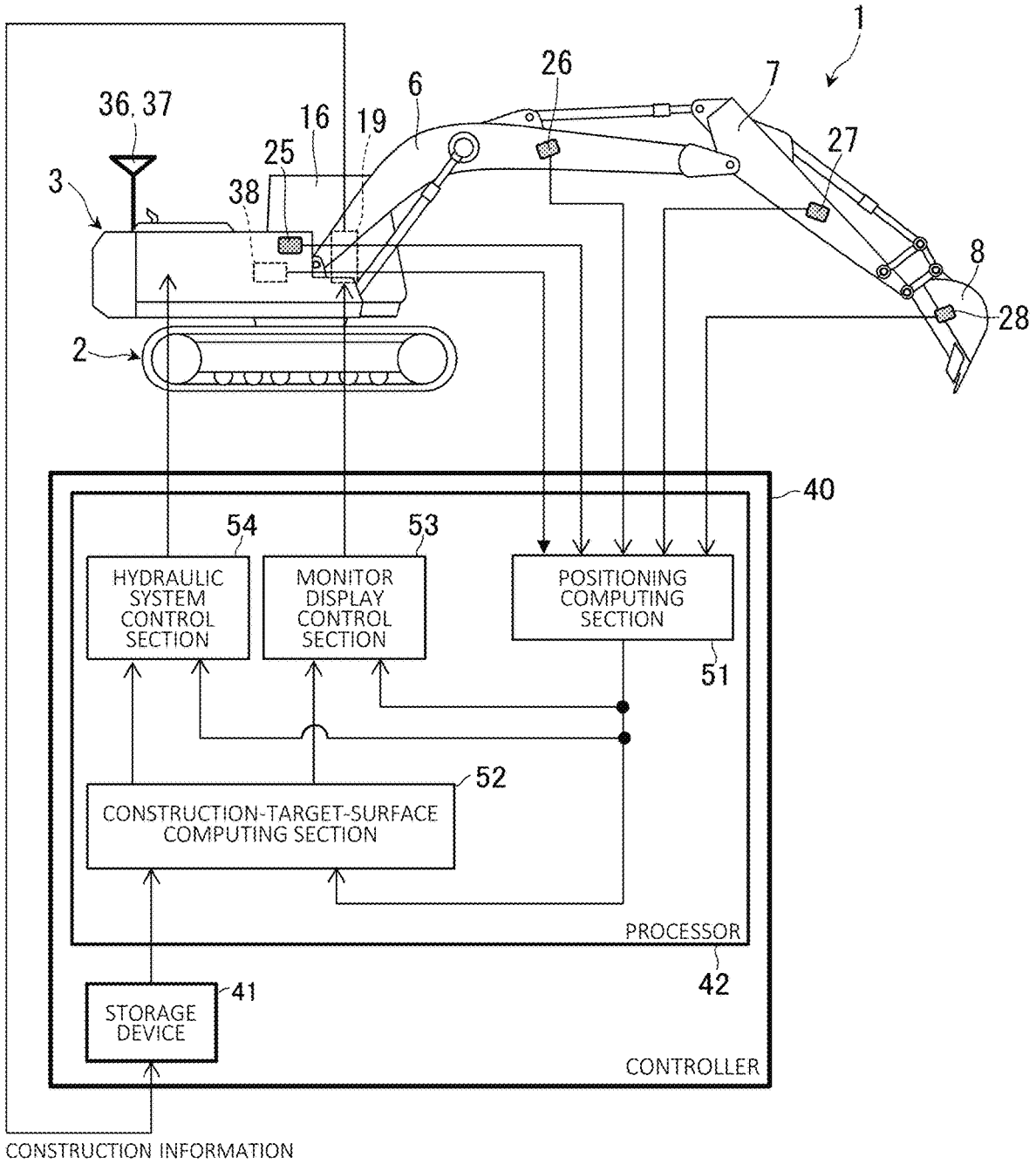
FIG. 2 is a figure depicting the construction machine according to the first embodiment of the present invention, and functional blocks of a controller included as part of the first embodiment.

First, a configuration of the hydraulic excavator as the construction machine according to a first embodiment of the present invention is explained by using FIG. 1 and FIG. 2. FIG. 1 is a perspective view depicting the hydraulic excavator to which the construction machine according to the first embodiment of the present invention is applied. FIG. 2 is a figure depicting the construction machine according to the first embodiment of the present invention, and functional blocks of a controller included as part of the first embodiment. Here, an explanation is given by using a direction as seen from an operator seated on the operator's seat.

In FIG. 1, the hydraulic excavator as the construction machine includes a front work implement 1 for performing excavation work or the like, and a machine body to which the front work implement 1 is attached pivotably. The machine body includes a lower track structure 2 that is capable of traveling, and an upper swing structure 3 mounted swingably on the lower track structure 2. The machine body changes its position along with actions such as a traveling action of the lower track structure 2 or a swinging action of the upper swing structure 3.

The front work implement 1 is an articulated-type work implement formed by coupling a plurality of driven members in a vertically pivotable manner. For example, the plurality of driven members include a boom 6, an arm 7, and a bucket 8 as a work tool. A base end portion of the boom 6 is supported pivotably at a front portion of the upper swing structure 3. A base end portion of the arm 7 is supported pivotably at a tip portion of the boom 6. The bucket 8 is supported pivotably at a tip portion of the arm 7. The boom 6, the arm 7, and the bucket 8 are respectively driven by a boom cylinder 10, an arm cylinder 11, and a bucket cylinder 12, which are hydraulic actuators. Note that the bucket 8 is driven via a link member 13 that pivots in conjunction with the bucket 8.

For example, the lower track structure 2 includes on its left side and right side crawler-type track devices 14 (only one side is depicted). The track devices 14 are driven by travel hydraulic motors 14*a*, which are hydraulic actuators.

For example, the upper swing structure 3 is configured to be swing-driven relative to the lower track structure 2 by a swing hydraulic motor 4, which is a hydraulic actuator. The upper swing structure 3 includes a cab 16 that an operator gets on, and a machine room 17 that houses various types of equipment.

The cab 16 is provided with operation devices 18*a*, 18*b*, and 18*c* for operating the hydraulic actuators 4, 10, 11, 12, and 14*a*. For example, the operation devices 18*a* and 18*b* are electric operation lever devices having operation levers that can incline forward, backward, leftward, and rightward. The electric operation lever devices 18*a* and 18*b* have sensors (not depicted) that electrically sense inclination directions and inclination amounts, that is, operation directions and operation amounts, of the operation levers, and output, to a controller 40 (see FIG. 2) via electric wires, operation signals according to the sensed operation directions and operation amounts. Front-back operation and left-right operation of the operation lever devices 18*a* and 18*b* are allocated as operation on the hydraulic actuators 4, 10, 11, and 12. That is, each type of operation on the operation lever devices 18*a* and 18*b* is allocated as operation on the front work implement 1, swing operation of the upper swing structure 3, or the like. The operation device 18*c* is an electric operation device having a travel lever that can incline forward and backward and a travel pedal. The operation device 18*c* is allocated as operation of the hydraulic actuators 14*a*, that is, travel operation of the left and right track devices 14. In addition, a monitor 19 (see FIG. 2) that can display various types of information and accept input of various types of information is installed in the cab 16.

Note that the operation devices 18*a*, 18*b*, and 18*c* may not be formed as electric operation devices but as hydraulic operation devices. In a case of this configuration, the hydraulic actuators 4, 10, 11, 12, and 14*a* are configured to be driven by supplying, as drive signals, operation pilot pressures according to the operation directions and operation amounts of the operation devices 18*a*, 18*b*, and 18*c* to control valves of a control valve unit 23.

A prime mover 21 such as an engine or an electric motor, a hydraulic pump apparatus 22 driven by the prime mover 21, and the like are arranged in the machine room 17. By a hydraulic fluid delivered from the hydraulic pump apparatus 22 being supplied to each of the hydraulic actuators 4, 10, 11, 12, and 14*a*, the hydraulic actuators 4, 10, 11, 12, and 14*a* are driven. Driving of the hydraulic actuators 4, 10, 11, 12, and 14*a* is controlled by the control valve unit 23, which is a group of control valves corresponding to the respective hydraulic actuators 4, 10, 11, 12, and 14*a*. Each control valve included in the control valve unit 23 controls a direction and a flow rate of the hydraulic fluid supplied from the hydraulic pump apparatus 22 to a corresponding one of the hydraulic actuators 4, 10, 11, 12, and 14*a*. For example, driving of each control valve is controlled by an operation pilot pressure output from a pilot pump (not depicted) via a solenoid proportional valve (not depicted). By each solenoid proportional valve being controlled by the controller 40 based on an operation signal from an operation device 18*a*, 18*b*, or 18*c*, an action of each of the hydraulic actuators 4, 10, 11, 12, and 14*a* is controlled via a corresponding control valve in the control valve unit 23.

As depicted in FIG. 1 and FIG. 2, an inertial measurement unit (IMU) 25 that measures information on the action and posture of the machine body is installed on the upper swing structure 3. In addition, on the boom 6, the arm 7, and the bucket 8, which are constituent members of the front work implement 1, also, inertial measurement units (IMUs) 26, 27, and 28 that measure information on the postures of the constituent members 6, 7, and 8 are installed, respectively. In order to make distinctions between these four inertial measurement units 25, 26, 27, and 28, the inertial measurement unit 25 for the upper swing structure 3 (machine body) is referred to as a machine-body IMU, the inertial measurement unit 26 for the boom 6 is referred to as a boom IMU, the inertial measurement unit 27 for the arm 7 is referred to as an arm IMU, and the inertial measurement unit 28 for the bucket 8 is referred to as a bucket IMU. Note that the bucket IMU 28 may be installed not on the bucket 8 but on the link member 13 that pivots in conjunction with the bucket 8.

Each IMU is a device including two sensors which are an acceleration sensor 31 and an angular velocity sensor 32 (see FIG. 4 regarding both), and also has an angle computation functionality (angle computing section 33) of computing an angle by using acceleration sensed by the acceleration sensor and an angular velocity sensed by the angular velocity sensor. The IMU computes an angle by using the following two computation methods in combination. A first method is to compute an angle relative to a reference plane (e.g., the horizontal plane) by comparing acceleration sensed by the acceleration sensor and gravitational acceleration. A second method is to compute an angle by integrating angular velocities sensed by the angular velocity sensor. It should be noted that the second method can calculate only an angular change relative to, as the start point, a certain angle that is measured when the construction machine is in a stationary state. Because of this, for IMU angle computation, the first method that can calculate any angle at a time when the construction machine is stationary is used mainly.

The machine-body IMU 25 senses acceleration and an angular velocity generated to the upper swing structure 3 (installation portion), and also performs angle computation of computing an angle of the installation portion 3 relative to the reference plane on the basis of sensing results (the acceleration and the angular velocity). Specifically, on the basis of the direction (vertically downward direction) of gravitational acceleration sensed in an IMU coordinate system set for the machine-body IMU 25 and the attachment state of the machine-body IMU 25 (the relative positional relation between the machine-body IMU 25 and the upper swing structure 3) when the upper swing structure 3 is in a stationary state, the machine-body IMU 25 can compute an inclination (pitch angle) of the upper swing structure 3 in the front-back direction relative to the horizontal plane and an inclination (roll angle) in the left-right direction (widthwise direction). The machine-body IMU 25 outputs, to the controller 40, sensing results (information on the action of the upper swing structure 3) of acceleration and an angular velocity of the upper swing structure 3 (machine body) and computation results (information on the posture of the machine body) of a pitch angle and a roll angle (angular information) of the machine body 2 and 3.

The boom IMU 26, the arm IMU 27, and the bucket IMU 28 sense angular velocities and acceleration of their respective installation portions (the boom 6, the arm 7, and the bucket 8), and also perform angle computation of computing the angles of the installation portions 6, 7, and 8 relative to the reference plane on the basis of the sensing results (the acceleration and the angular velocities). Similarly to the machine-body IMU 25, when the machine body is stationary, the boom IMU 26, the arm IMU 27, and the bucket IMU 28 can compute angular information on the constituent members 6, 7, and 8 of the front work implement 1 on the basis of the directions of gravitational acceleration sensed in IMU coordinate systems set for the IMUs 26, 27, and 28 and the attachment states of the IMUs 26, 27, and 28 (the relative positional relation with the constituent members 6, 7, and 8). The boom IMU 26, the arm IMU 27, and the bucket IMU 28 respectively output, to the controller 40, the sensing results of the angular velocities and the acceleration of the constituent members 6, 7, and 8 and the computation results of the angular information on the constituent members 6, 7, and 8 (information on the postures of the constituent members 6, 7, and 8).

These four IMUs, i.e., the machine-body IMU 25, the boom IMU 26, the arm IMU 27, and the bucket IMU 28, sense the acceleration and the angular velocities of the upper swing structure 3 and the constituent members 6, 7, and 8 of the front work implement 1, and perform angle computation based on the acceleration and the angular velocities which are sensing results, so that they function as an angle measuring apparatus that measure information on the posture of the construction machine.

Two GNSS antennas 36 and 37 as receivers that receives positioning signals from a plurality of satellites are attached to the upper swing structure 3. Positioning signals received by each GNSS antenna 36 or 37 are input to a GNSS receiver 38 depicted in FIG. 2. The GNSS receiver 38 functions as a positioning computing device that performs positioning computation such as computation of antenna coordinates (the positions of particular portions on the machine body) or computation of the azimuth of the upper swing structure 3 (machine body), based on the positioning signals received by the GNSS antennas 36 and 37. The GNSS antennas 36 and 37 and the GNSS receiver 38 form a positioning system 35 (see FIG. 4) that performs satellite positioning of the hydraulic excavator. Since the GNSS receiver 38 uses statistical processes for computation of the positions and the azimuth mentioned above, the GNSS receiver 38 simultaneously calculates variances of the positions and the azimuth also, in addition to the positions and the azimuth. In addition, the GNSS receiver 38 can compute not only the positions of the GNSS antennas 36 and 37 (machine body) but also speeds of the GNSS antennas 36 and 37. The GNSS receiver 38 outputs, to the controller 40, the positions and speeds of the GNSS antennas 36 and 37 (machine body), the azimuth of the upper swing structure 3 (machine body), and the variances of the positions, the speeds, and the azimuth which are computation results of positioning computation.

The GNSS receiver 38 (positioning system 35) can execute RTK (Real Time Kinematic) positioning by being connected to a GNSS fixed station installed in a site via wireless communication. In a case where there are no GNSS fixed stations in a site, it is possible to execute positioning using network-type RTK of acquiring information on an electronic base station via the Internet. It is supposed in the explanation below that the GNSS receiver 38 can execute RTK positioning irrespective of whether or not there is a fixed station in the site.

As depicted in FIG. 2, the controller 40 executes action control of the hydraulic excavator and operation assistance for an operator on the basis of computation results of the GNSS receiver 38, sensing results and angle computation results of the machine-body IMU 25, the boom IMU 26, the arm IMU 27, and the bucket IMU 28, and the like. For example, the controller 40 includes, as its hardware configuration, a storage device 41 including a RAM, a ROM, and the like and a processor 42 including a CPU, an MPU, or the like. The storage device 41 has stored thereon in advance programs and various types of information necessary for action control of the hydraulic excavator. The processor 42 realizes various types of functionality including the following functionalities by reading in programs and various types of information as appropriate from the storage device 41 and executing processes according to the programs.

The controller 40 has, as some of functionalities executed by the processor 42, a positioning computing section 51, a construction-target-surface computing section 52, a monitor display control section 53, and a hydraulic system control section 54.

The positioning computing section 51 performs posture computation of computing the position (coordinates) and azimuth of the hydraulic excavator in a work site and postural information on the front work implement 1 on the basis of computation results of the GNSS receiver 38 and sensing results and computation results of angle computation by the machine-body IMU 25, the boom IMU 26, the arm IMU 27, and the bucket IMU 28. To calculate postural information on the front work implement 1, it is necessary to compute a relative angle between each pair of members in the coupled relation in the upper swing structure 3 and the boom 6, the arm 7, and the bucket 8 forming the front work implement 1. Specifically, the relative angle of the boom 6 is calculated based on an angle which is a computation result of the machine-body IMU 25 and an angle which is a computation result of the boom IMU 26. The relative angle of the arm 7 is calculated based on an angle which is a computation result of the boom IMU 26 and an angle which is a computation result of the arm IMU 27. The relative angle of the bucket 8 is calculated based on an angle which is a computation result of the arm IMU 27 and an angle which is a computation result of the bucket IMU 28. The positioning computing section 51 outputs computation results to the construction-target-surface computing section 52, the monitor display control section 53, and the hydraulic system control section 54. The accuracy of computation results of the positioning computing section 51 (errors relative to the actual position and posture of the hydraulic excavator) influences computation and control by the sections 52, 53, and 54 undesirably. Accordingly, computation results of the positioning computing section 51 are required to be of high accuracy. Details of a configuration of the positioning computing section 51 are mentioned later.

The construction-target-surface computing section 52 computes a construction-target surface defining a target shape of a construction subject, on the basis of construction information such as three-dimensional construction figures stored in advance on the storage device 41 and positional information and postural information on the hydraulic excavator which are computation results of the positioning computing section 51. For example, the construction information is one that is input by a construction manager via the monitor 19 or the like as an input device. In addition, the construction-target-surface computing section 52 calculates a distance between the construction-target surface and a reference point (e.g., the claw tip of the bucket 8). Note that the construction-target surface can also be set by an operator operating the monitor 19 on the spot. The construction-target-surface computing section 52 outputs computation results to the monitor display control section 53 and the hydraulic system control section 54.

The monitor display control section 53 controls display on the monitor 19 in the cab 16. On the basis of the construction-target surface as a computation result of the construction-target-surface computing section 52 and the positional information and postural information on the hydraulic excavator as computation results of the positioning computing section 51, the monitor display control section 53 computes instruction contents of operation assistance for an operator, and displays the computation result on the monitor 19 that functions as a display device. For example, by displaying, on the monitor 19, the posture of the front work implement 1 and the tip position and angle of the bucket 8 of the front work implement 1, the monitor display control section 53 serves as part of the functionality as a machine guidance system that assists operation by the operator. In a case where an anomaly occurs in positioning results of the GNSS receiver 38, or in a case where the accuracy of angular information as a computation result of any of the four IMUs 25, 26, 27, and 28 fails to satisfy set required accuracy, execution of guidance may be stopped, or a warning for suspending the guidance may be displayed on the monitor 19, in one possible manner of configuration. In addition, a work instruction or a cautionary notice may be given not only by screen display on the monitor 19 but also by outputting sound, in another possible manner of configuration. That is, the monitor display control section 53 is configured to take a negative measure against execution of the guidance in a case where there is a problem in a positioning result of the GNSS receiver 38 or a computation result of the IMU 25, 26, 27, or 28.

Note that it is desirable if the monitor 19 can be used not merely as a display device but as an input device by including a touch panel. For example, the monitor 19 may be installed fixedly in the cab 16 or may be a portable tablet terminal that is installed detachably in the cab 16, in one possible manner of configuration.

The hydraulic system control section 54 controls a hydraulic system including the hydraulic pump apparatus 22, the plurality of hydraulic actuators 4, 10, 11, 12, and 14*a*, and the control valve unit 23 (see FIG. 1 regarding all of them). For example, on the basis of the construction-target surface as a computation result of the construction-target-surface computing section 52 and the positional information and postural information on the hydraulic excavator as computation results of the positioning computing section 51, the hydraulic system control section 54 computes an action of the hydraulic excavator and controls the hydraulic system in such a manner that the computation-result action is realized. The hydraulic system control section 54 serves as part of the functionality as a machine control system that, for example, restricts an action in such a manner that the tip of the bucket 8 does not approach the construction-target surface more than a predetermined degree, and that performs control in such a manner that the bucket 8 moves along the construction-target surface. It is desirable if, in a case where the monitor display control section 53 stops execution of the guidance when an anomaly has occurred in a positioning result of the GNSS receiver 38 or when the accuracy of angular information as a computation result of any of the four IMUs 25, 26, 27, and 28 fails to satisfy predetermined required accuracy, the hydraulic system control section 54 stops a machine control functionality accordingly.

One that combines functionalities of both the construction-target-surface computing section 52 and the monitor display control section 53 is called a machine guidance system below. In addition, one that combines functionalities of both the construction-target-surface computing section 52 and the hydraulic system control section 54 is called a machine control system.

Whereas the one controller 40 is configured to execute all the functional sections depicted in FIG. 2 in the present embodiment, the functional sections may be executed by mutually different controllers, in another possible manner of configuration. In a case where the functional sections are implemented by different controllers, the group of controllers forming the functional sections forms a controller that computes postural information on the hydraulic excavator and executes operation assistance of the front work implement 1.

Next, accuracy deterioration of IMU angle computation that influences execution of machine guidance or machine control by the controller is explained. In order to compute postural information on the hydraulic excavator, the positioning computing section 51 in the controller 40 uses computation results of the GNSS receiver 38 (positioning system 35) using positioning signals of satellites and sensing results and computation results of the four IMUs 25, 26, 27, and 28. The postural information as a computation result of the positioning computing section 51 is used by the monitor display control section 53 and the hydraulic system control section 54. If the accuracy of angular information as a computation result of each IMU 25, 26, 27, or 28 deteriorates, the accuracy deterioration of the angular information influences a computation result of the positioning computing section 51, and so there is a concern that the claw-tip position of the bucket 8 displayed on the monitor 19 by the monitor display control section 53 shifts away from an actual position undesirably and appropriate machine guidance cannot be executed. In addition, there is a concern that the claw-tip position of the bucket 8 controlled by the hydraulic system control section 54 is different from an actual position undesirably and the finished surface has a waved shape undesirably.

Figure 3:
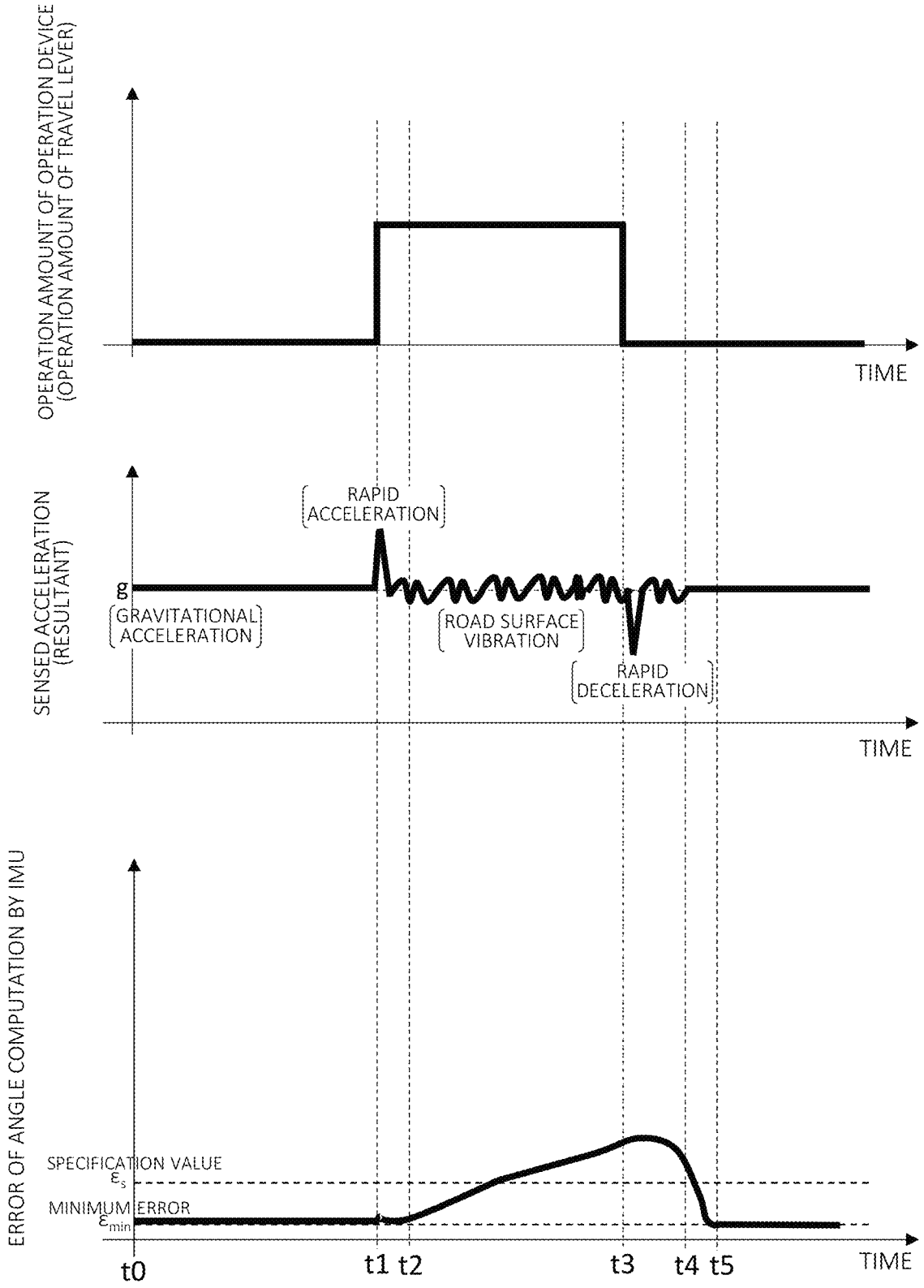
FIG. 3 is an explanatory diagram depicting accuracy deterioration of angle computation by an inertial measurement unit (IMU) included as part of the construction machine according to the first embodiment of the present invention.

A specific example of occurrence of accuracy deterioration of angular information as a computation result of the IMU 25, 26, 27, or 28 is explained below by using FIG. 3. FIG. 3 is an explanatory diagram depicting accuracy deterioration of angle computation by an inertial measurement unit (IMU) included as part of the construction machine according to the first embodiment of the present invention. In FIG. 3, the top diagram depicts an operation amount of an operation device (the travel lever or the travel pedal), the middle diagram depicts an example of resultant acceleration sensed by the IMU, and the bottom diagram depicts an example of differences between computation results of angle computation by the IMU and a true angle (errors of an angle computed by the IMU). The IMU is any one of the machine-body IMU 25, the boom IMU 26, the arm IMU 27, and the bucket IMU 28.

As depicted in the top diagram in FIG. 3, the travel lever or the travel pedal (see FIG. 1) of the operation device 18*c* is not operated from an initial time t0 to a time t1, and the hydraulic excavator is in a stopped state without traveling. Accordingly, as depicted in the middle diagram in FIG. 3, the resultant acceleration sensed by the IMU substantially matches gravitational acceleration g. At this time, since the hydraulic excavator is in a stationary state, the first method is used as the method of angle computation of the IMU. It should be noted that an angle as a computation result by the IMU does not completely match a true (actual) angle due to biases (constant errors) of the acceleration sensor, quantization errors at the acceleration sensor, or the like. An angular error that is generated at a time of a stationary state (from the time t0 to the time t1 depicted in the bottom diagram in FIG. 3) in angle computation of the IMU is called a minimum error $\varepsilon_{min}$. The minimum error $\varepsilon_{min}$ has a value smaller than a specification value (a margin of error) $\varepsilon_s$ regarding computation accuracy of the IMU for the normal state.

As depicted in the top diagram in FIG. 3, the operation device 18*c* (the travel lever or the travel pedal) is operated at the time t1. This switches the hydraulic excavator from a stopped state to a traveling action, and so acceleration is generated to the hydraulic excavator. At this time, as depicted in the middle diagram in FIG. 3, the resultant acceleration sensed by the IMU no longer matches the gravitational acceleration g, and so the IMU cannot use the first computation method. In view of this, the IMU switches the computation method from the first method to the second method and performs angle computation by the second method. As depicted in the bottom diagram in FIG. 3, a rapid increase of errors of the computation angle at and after the time t1 is prevented by switching the computation method at an appropriate timing. However, since sensing results (angular velocities) of the angular velocity sensor are integrated in angle computation by the second method, if it is applied for a long time, the influence of biases of the angular velocity sensor is accumulated, and the accuracy of computation results deteriorates undesirably (errors of the computation angle increase undesirably).

From a time t2 to a time t3, as depicted in the top diagram in FIG. 3, the operation amount of the operation device 18*c* (the travel lever or the travel pedal) is substantially constant, and so the traveling speed of the hydraulic excavator becomes substantially constant. Because of this, acceleration due to traveling is no longer generated to the hydraulic excavator. It should be noted that, even if the hydraulic excavator is traveling at a substantially constant speed (from the time t2 to the time t3), as depicted in the middle diagram in FIG. 3, the resultant acceleration sensed by the IMU does not always match the gravitational acceleration g. This is because, unlike automobiles that travel on paved road surfaces, the hydraulic excavator travels on irregular road surfaces at a work site, also the track devices 14 (see FIG. 1) travel by driving of metallic crawlers, and so relatively large vibrations occur during traveling. Hence, the first method cannot be used for angle computation of the IMU during traveling of the hydraulic excavator. However, if the second method is used continuously, the influence of biases of the angular velocity sensor is accumulated, and hence, errors of the computation angle gradually increase as depicted in the bottom diagram in FIG. 3.

As depicted in the top diagram in FIG. 3, operation of the operation device 18*c* is stopped at the time t3. This rapidly decelerates the hydraulic excavator, and so the resultant acceleration sensed by the IMU varies significantly relative to the gravitational acceleration g again as depicted in the middle diagram in FIG. 3. Thereafter, the translational acceleration of the hydraulic excavator becomes zero, but machine body vibrations generated by the rapid deceleration continue. At a time t4, finally, the hydraulic excavator enters a completely stopped state as depicted in the middle diagram in FIG. 3.

In this case, the method of angle computation by the IMU switches from the second method to the first method at an appropriate timing after the complete stop of the hydraulic excavator. At this time of switching of the computation method, the continuity of computation results is ensured by performing a process such as interpolation or filtering on results of computation by the second method and results of computation by the first method. Accordingly, because of this, even if the hydraulic excavator stops completely and the method of angle computation by the IMU switches to the first method, errors resulting from the second computation method remain in angular information output by the IMU for a while after the construction machine has stopped completely, and so errors of the angle computed by the IMU do not become the minimum error $\varepsilon_{min}$ at the time t4 immediately. That is, errors of the angle computed by the IMU gradually decrease also at and after the time t4 at which the machine body has stopped completely, as depicted in the bottom diagram in FIG. 3, and converge to the minimum error $\varepsilon_{min}$ at a time t5.

In this manner, also for a while after a transition from a traveling action to a stopped state, the accuracy (errors) of the angle computed by the IMU cannot satisfy the specification value (a margin of error) $\varepsilon_s$ for the normal state in some cases. Accordingly, operation assistance is performed according to inaccurate postural information computed based on low-accuracy angular information output by the IMU if machine guidance is executed at the time t4 by using, as a factor for decision making, only information that a traveling action is not being performed and that the hydraulic excavator is in a stopped state, and so there is a concern that a construction surface is damaged undesirably. This also holds true not only of a case of a transition from a traveling action to a stopped state but also of a case of a transition from a swinging action to a stopped state.

Because of this, in a case where operation assistance such as machine guidance or machine control is executed, it is necessary to take into consideration the fact that, even if the hydraulic excavator is in a stopped state, the accuracy (errors) of the angle computed by IMUs fails to satisfy required accuracy (a margin of error) in some cases for a predetermined period after a transition from a traveling or swinging action state to a stopped state. In view of this, the controller 40 according to the present embodiment is configured to assess whether or not there is accuracy deterioration of angles computed by IMUs after a transition from a traveling action or a swinging action of the machine body (upper swing structure 3) to a stopped state. The controller 40 is configured to stop operation assistance of the work implement 1 such as machine guidance or machine control or to give a warning or the like when it is determined that the accuracy (errors) of angles computed by IMUs fails to satisfy required accuracy (acceptable angle), in order to inhibit use of inaccurate postural information based on low-accuracy angular information output by the IMUs.

Figure 4:
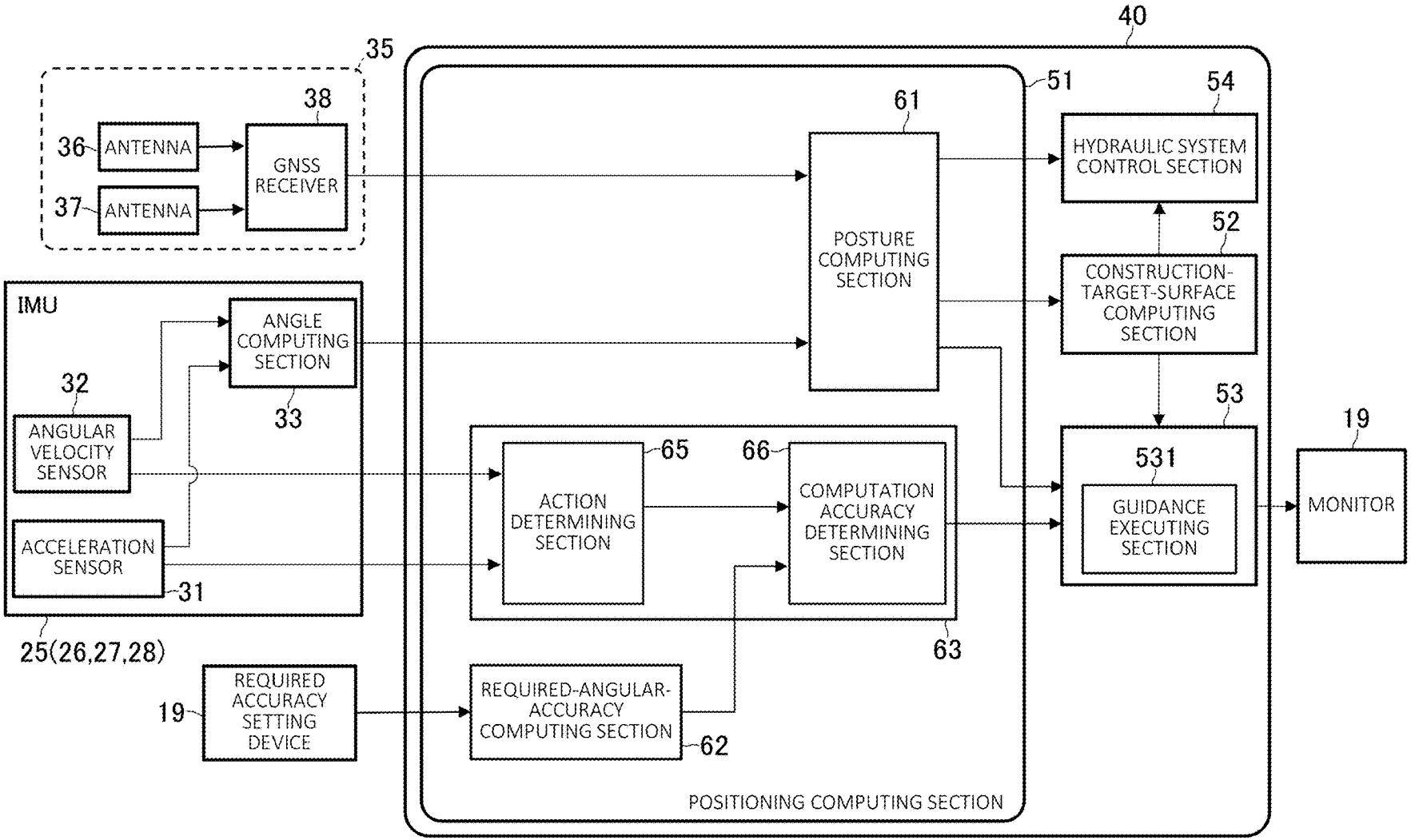
FIG. 4 is a block diagram depicting a functional configuration of a positioning computing section and a functional configuration of a monitor display section in the controller depicted in FIG. 2.
Figure 5:
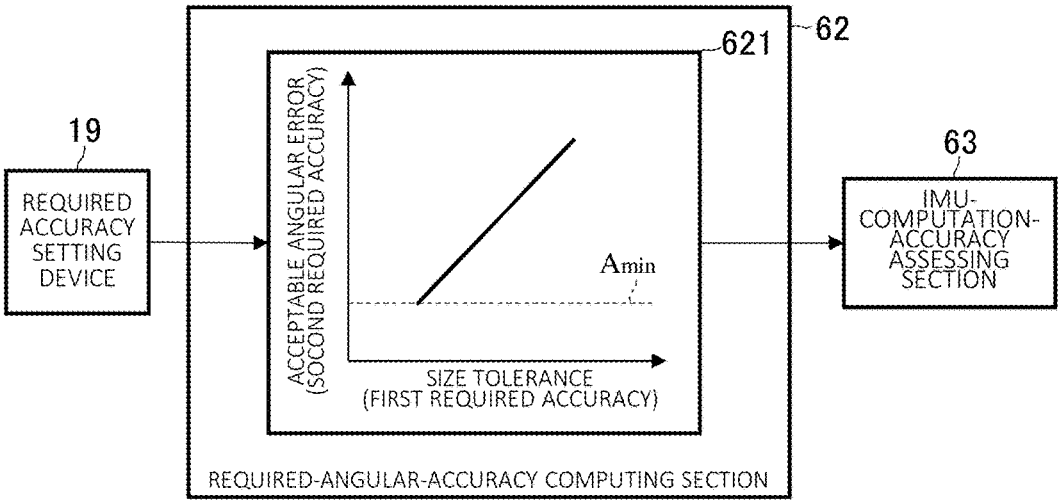
FIG. 5 is a block diagram depicting a functional configuration of a required-angular-accuracy computing section included as part of the positioning computing section in the controller depicted in FIG. 4.
Figure 6:
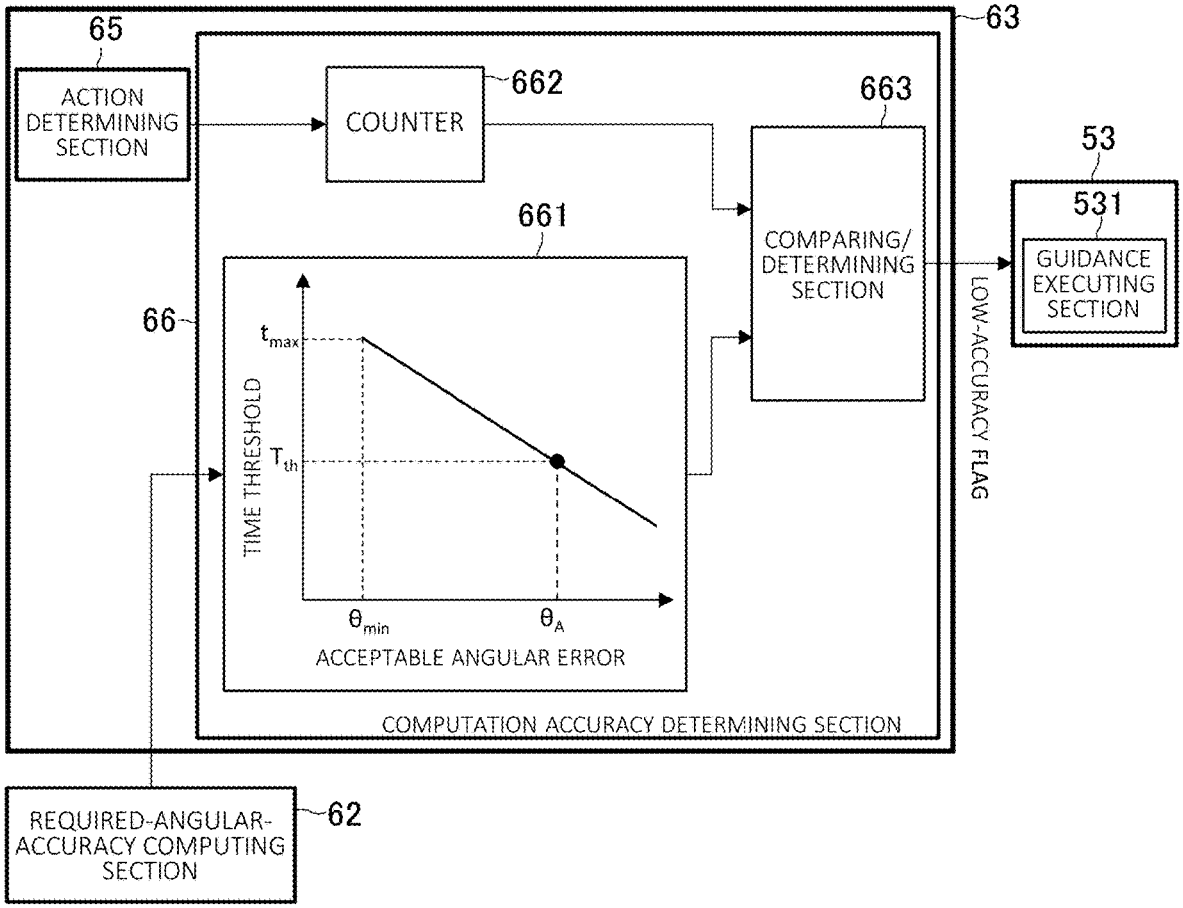
FIG. 6 is a block diagram depicting a functional configuration of an IMU-computation-accuracy assessing section included as part of the positioning computing section in the controller depicted in FIG. 4.

Next, details of a functional configuration of the positioning computing section and a functional configuration of the monitor display control section in the controller in the construction machine according to the first embodiment of the present invention are explained by using FIG. 4 to FIG. 6. FIG. 4 is a block diagram depicting the functional configuration of the positioning computing section and the functional configuration of the monitor display section in the controller depicted in FIG. 2. FIG. 5 is a block diagram depicting a functional configuration of a required-angular-accuracy computing section included as part of the positioning computing section in the controller depicted in FIG. 4. FIG. 6 is a block diagram depicting a functional configuration of an IMU-computation-accuracy assessing section included as part of the positioning computing section in the controller depicted in FIG. 4.

In FIG. 4, the controller 40 is configured to take in information from the positioning system 35, information from the IMUs 25, 26, 27, and 28, and information from a required accuracy setting device 19. On the basis of positioning signals from a plurality of satellites received by the GNSS antennas 36 and 37, the positioning system 35 outputs, to the controller 40, information on a position computed by the GNSS receiver 38 and the variance of the position.

Each IMU 25, 26, 27, or 28 includes the acceleration sensor 31 that senses acceleration and the angular velocity sensor 32 that senses an angular velocity. In addition, each IMU 25, 26, 27, or 28 has a functionality as the angle computing section 33 that performs angle computation of computing the angle of the portion where the IMU 25, 26, 27, or 28 is installed relative to the reference plane, based on the acceleration sensed by the acceleration sensor 31 and the angular velocity sensed by the angular velocity sensor 32. Each IMU 25, 26, 27, or 28 outputs, to the controller 40, each piece of information on the acceleration sensed by the acceleration sensor 313, the angular velocity sensed by the angular velocity sensor 23, and the angle computed by the angle computing section 33.

The required accuracy setting device includes, for example, the monitor 19 having an input device, and is used to set required accuracy of information used for operation assistance of the front work implement 1. Specifically, on the required accuracy setting device 19, as finishing accuracy which is required accuracy of information for operation assistance, for example, a margin of size error (size tolerance) can be input through operation by an operator. For example, the size tolerance concerning finishing accuracy can be set to 10 cm at rough excavation, 2 cm at finishing excavation, and the like, depending on actions of the hydraulic excavator.

The positioning computing section 51 in the controller 40 has a posture computing section 61 that computes postural information representing the posture of the hydraulic excavator, a required-angular-accuracy computing section 62 that computes required accuracy (second required accuracy) of angle computation by the IMUs 25, 26, 27, and 28, and an IMU-computation-accuracy assessing section 63 that assesses the accuracy of angle computation by the IMUs 25, 26, 27, and 28.

Specifically, the posture computing section 61 computes the postural information by using computation results (positions, azimuths, and the variances thereof) of the positioning system 35, and sensing results (acceleration and angular velocities) and computation results (angles) of the IMUs 25, 26, 27, and 28. For example, the postural information is various types of three-dimensional coordinates necessary for machine guidance or machine control such as a middle position of the claw tip of the bucket 8. Since this computation is performed according to typical geometric relations, detailed explanations thereof are omitted. The postural information as a computation result of the posture computing section 61 is output to the construction-target-surface computing section 52, the monitor display control section 53, and the hydraulic system control section 54 and used for machine guidance or machine control.

The required-angular-accuracy computing section 62 determines whether or not required accuracy (first required accuracy) has been set by the required accuracy setting device 19. Further, when required accuracy has been set, the required-angular-accuracy computing section 62 computes required accuracy (second required accuracy) of computation results of angle computation by the IMUs 25, 26, 27, and 28 based on required accuracy (first required accuracy) set by the required accuracy setting device 19.

Specifically, the required-angular-accuracy computing section 62 converts a size tolerance as the required accuracy (first required accuracy) of information for operation assistance into a margin of angular error (acceptable angular error) as the required accuracy (second required accuracy) of computation results of angle computation by the IMUs 25, 26, 27, and 28. For example, as depicted in FIG. 5, the required-angular-accuracy computing section 62 includes an error conversion table 621 used for converting a margin of size error (size tolerance) input on the required accuracy setting device 19 into a margin of angular error (acceptable angular error). For example, the error conversion table 621 is derived from relations that are calculated in advance by numerical calculation that gives, for example, an acceptable angular error of 0.5 degrees when the finishing accuracy (size tolerance) is 10 cm, an acceptable angular error of 0.1 degrees when the finishing accuracy is 2 cm, and so on. The required-angular-accuracy computing section 62 outputs, to the IMU-computation-accuracy assessing section 63, one acceptable angular error (first required accuracy) for a size tolerance as required accuracy (first required accuracy) set by the required accuracy setting device 19.

The minimum value of the acceptable angular error is determined according to specification values of the IMUs 25, 26, 27, and 28 and is called a minimum acceptable angular error $A_{min}$. It is desirable if input, on the required accuracy setting device 19, of numerical values smaller than a size tolerance corresponding to the minimum acceptable angular error $A_{min}$ is restricted. For example, in a case where the size tolerance corresponding to the minimum acceptable angular error $A_{min}$ is 2.0 cm, and an operator attempts to input 1.0 cm as finishing accuracy by operating the required accuracy setting device 19, it is desirable if the controller 40 outputs a warning message prompting to set the finishing accuracy to a value equal to or greater than 2.0 cm on the required accuracy setting device 19.

As depicted in FIG. 4, the IMU-computation-accuracy assessing section 63 includes an action determining section 65 that determines whether or not there are a traveling action and a swinging action of the machine body 2 and 3 that influence the accuracy of angle computation by the IMUs 25, 26, 27, and 28 on the basis of sensing results (acceleration and angular velocities) of the IMUs 25, 26, 27, and 28, and a computation accuracy determining section 66 that determines whether or not the accuracy of angle computation by the IMUs 25, 26, 27, and 28 satisfies the second required accuracy as a computation result of the required-angular-accuracy computing section 62.

The action determining section 65 determines whether the machine body 2 and 3 is in an active state (a traveling state or a swing state) or in a stopped state, based on the acceleration and the angular velocities as sensing results of the IMUs 25, 26, 27, and 28. That is, when any of the acceleration and the angular velocities sensed by the IMUs 25, 26, 27, and 28 exceeds thresholds, it is determined that the machine body 2 and 3 is in an active state; on the other hand, when they are equal to or lower than the thresholds, it is determined that the machine body 2 and 3 is in a stopped state. In addition, the action determining section 65 also makes an action stop determination of determining whether or not the state of the machine body 2 and 3 has changed from an active state (a traveling state or a swing state) to a stopped state. The action determining section 65 outputs a result of the determination about the action state of the machine body 2 and 3 to the computation accuracy determining section 66.

More specifically, for example, x-axis acceleration, y-axis acceleration, and z-axis acceleration sensed by the machine-body IMU 25 are defined as Ax, Ay, and Az, respectively. In a case where resultant acceleration Acc of the three axes does not match the gravitational acceleration g, or in a case where an angular velocity of any of the three axes is not zero, it is determined that the machine body 2 and 3 is in an active state (a traveling action or a swinging action). It should be noted that, since sensing values of the machine-body IMU 25 have biases (constant errors), include noise, and so on, it is desirable if thresholds are set for determination. For example, in a case where an acceleration threshold is defined as $A_{th}$, an angular velocity threshold is defined as $\omega_{th}$, and any of the following formulae (Formula 1) to (Formula 5) holds true, the action determining section 65 determines that the machine body 2 and 3 is in an active state.

$$Acc > g + A_{th} \quad \text{(Formula 1)}$$

$$Acc < g - A_{th} \quad \text{(Formula 2)}$$

$$|\omega x| > \omega_{th} \quad \text{(Formula 3)}$$

$$|\omega y| > \omega_{th} \quad \text{(Formula 4)}$$

$$|\omega z| > \omega_{th} \quad \text{(Formula 5)}$$

Note that ωx, ωy, and ωz mean sensing values of the x-axis, y-axis, and z-axis angular velocities, respectively, of the machine-body IMU 25.

For example, as depicted in FIG. 6, the computation accuracy determining section 66 includes a time conversion table 661 in which time thresholds as the comparison subject of accuracy determination are set based on the second required accuracy (acceptable angular error) of computation results of the required-angular-accuracy computing section 62, a counter 662 that counts elapsed time t since a certain time, and a comparing/determining section 663 that determines whether or not the accuracy of angle computation by the IMU satisfies the second required accuracy by comparing the elapsed time t counted by the counter 662 with a time threshold output by the time conversion table 661. The computation accuracy determining section 66 can be realized by comparing output of the IMUs mounted on the hydraulic excavator with output of high-accuracy angle sensors to acquire in advance experiment data representing the relation between the action state of the hydraulic excavator and errors of the angle computed by the IMUs like the one depicted in the bottom diagram in FIG. 3, and creating the time conversion table 661 based on the relation of the experiment data. For example, by using an experimental unit mounted thereon a fiber optical gyroscope (FOG) that is too expensive to be mounted on the hydraulic excavator but excels in accuracy, time series data of errors of angles computed by the IMUs depicted in the bottom diagram in FIG. 3 can be acquired.

The time conversion table 661 specifies the relation of a time threshold $T_{th}$ corresponding to an acceptable angular error ea as the second required accuracy which is a computation result of the required-angular-accuracy computing section 62. The relation of the time threshold with the acceptable angular error in the time conversion table 661 has characteristics that, as the acceptable angular error increases (the second required accuracy lowers), the time threshold decreases, and, on the other hand, as the acceptable angular error decreases (the second required accuracy rises), the time threshold increases. In response to input of an acceptable angular error as a computation result of the required-angular-accuracy computing section 62, the time conversion table 661 outputs a time threshold to the comparing/determining section.

For example, the relation in the time conversion table 661 is obtained from experiment data representing the temporal transition of errors of the computation angle from the time t4 (the time at and after which the resultant acceleration sensed by the IMUs substantially matches the gravitational acceleration) to the time t5 (the time at which an error of the computation angle of the IMUs becomes the minimum error $\varepsilon_{min}$) in the bottom diagram in FIG. 3. That is, the relation is specified based on the temporal transition of errors of the computation angle from the start point which is the timing at which the state of the machine body of the hydraulic excavator has changed from a traveling state or a swing state to a stopped state until the time at which the minimum error $\varepsilon_{min}$ is reached. That is, the relation in the time conversion table 661 represents that, even if the state of the machine body has changed from a traveling state or a swing state to a stopped state, a lapse of a certain length of time is required for errors of angle computation by the IMU to converge to the required accuracy. In the time conversion table 661, independently of input from the required-angular-accuracy computing section 62, a time threshold $t_{max}$ required for reaching a minimum acceptable angular error $\theta_{min}$ (a period equivalent to elapsed time from the time t4 to the time t5 in the bottom diagram in FIG. 3) is determined in advance.

The counter 662 measures elapsed time since a time at which the action determining section 65 determined that the state of the machine body 2 and 3 has changed from a traveling state or a swing state to a stopped state. The counter 662 outputs the measured elapsed time t to the comparing/determining section 663.

By comparing the elapsed time t measured by the counter 662 with the time threshold $T_{th}$ output by the time conversion table 661, the comparing/determining section 663 determines whether or not the accuracy of angle computation by the IMUs 25, 26, 27, and 28 satisfies the second required accuracy as a computation result of the required-angular-accuracy computation 62. When the elapsed time t of the counter 662 is shorter than the time threshold $T_{th}$ of the time conversion table 661, the comparing/determining section 663 determines that the accuracy of angle computation by the IMUs 25, 26, 27, and 28 fails to satisfy the second required accuracy, and a low-accuracy flag representing that the angle computation by the IMUs fails to satisfy the required accuracy is set to true. On the other hand, when the elapsed time t of the counter 662 is equal to or longer than the time threshold $T_{th}$ of the time conversion table 661, it is determined that the accuracy of angle computation by the IMUs 25, 26, 27, and 28 satisfies the second required accuracy, and the low-accuracy flag is set to false. Note that, when the elapsed time t of the counter 662 becomes equal to or longer than the maximum time threshold $t_{max}$ of the time conversion table 661, it can automatically be determined that the accuracy of angle computation by the IMUs 25, 26, 27, and 28 satisfies the second required accuracy. The comparing/determining section 663 outputs, to the monitor display control section 53, the low-accuracy flag set to true or false according to the comparison/determination.

As depicted in FIG. 4, the monitor display control section 53 in the controller 40 includes a guidance executing section 531 that displays, on the monitor 19, postural information of the hydraulic excavator as a computation result of the posture computing section 61 in the positioning computing section 51. According to whether the low-accuracy flag has been set to true or false, as an assessment result of the IMU-computation-accuracy assessing section 63, the guidance executing section 531 also decides to continue or stop execution of machine guidance. When the low-accuracy flag has been set to true, execution of machine guidance is stopped. Note that, instead of stopping execution of machine guidance, the guidance executing section 531 may display, on the monitor, a warning about execution of machine guidance or an instruction prompting to stop work, in another possible manner of configuration. That is, the guidance executing section 531 is configured to take a negative measure against execution of machine guidance when the low-accuracy flag has been set to true.

Figure 7:
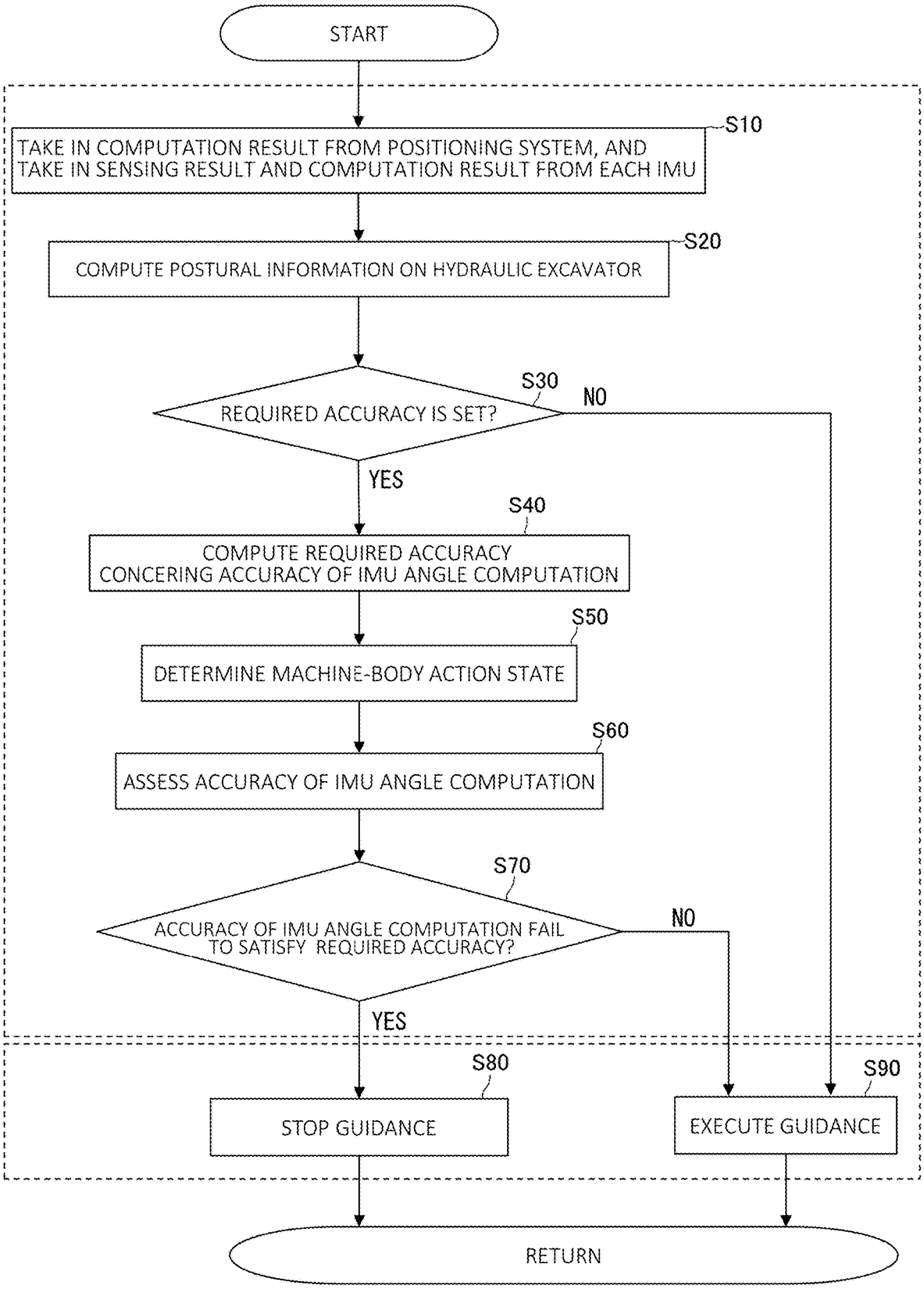
FIG. 7 is a flowchart depicting an example of a procedure of a decision about guidance execution by the controller included in the construction machine according to the first embodiment of the present invention.
Figure 8:
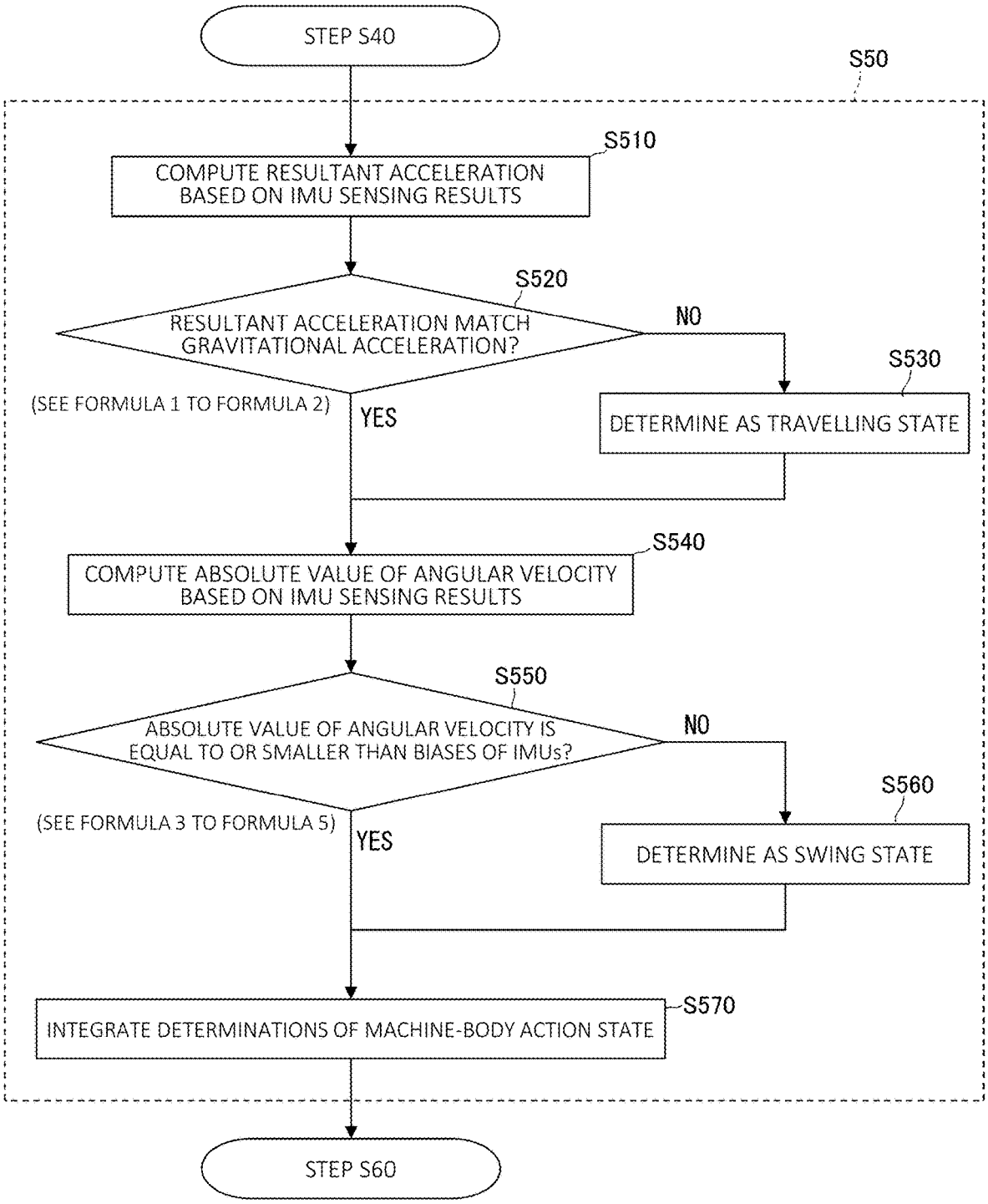
FIG. 8 is a flowchart depicting an example of a procedure of a determination about a machine-body action state in the flowchart depicted in FIG. 7.
Figure 9:
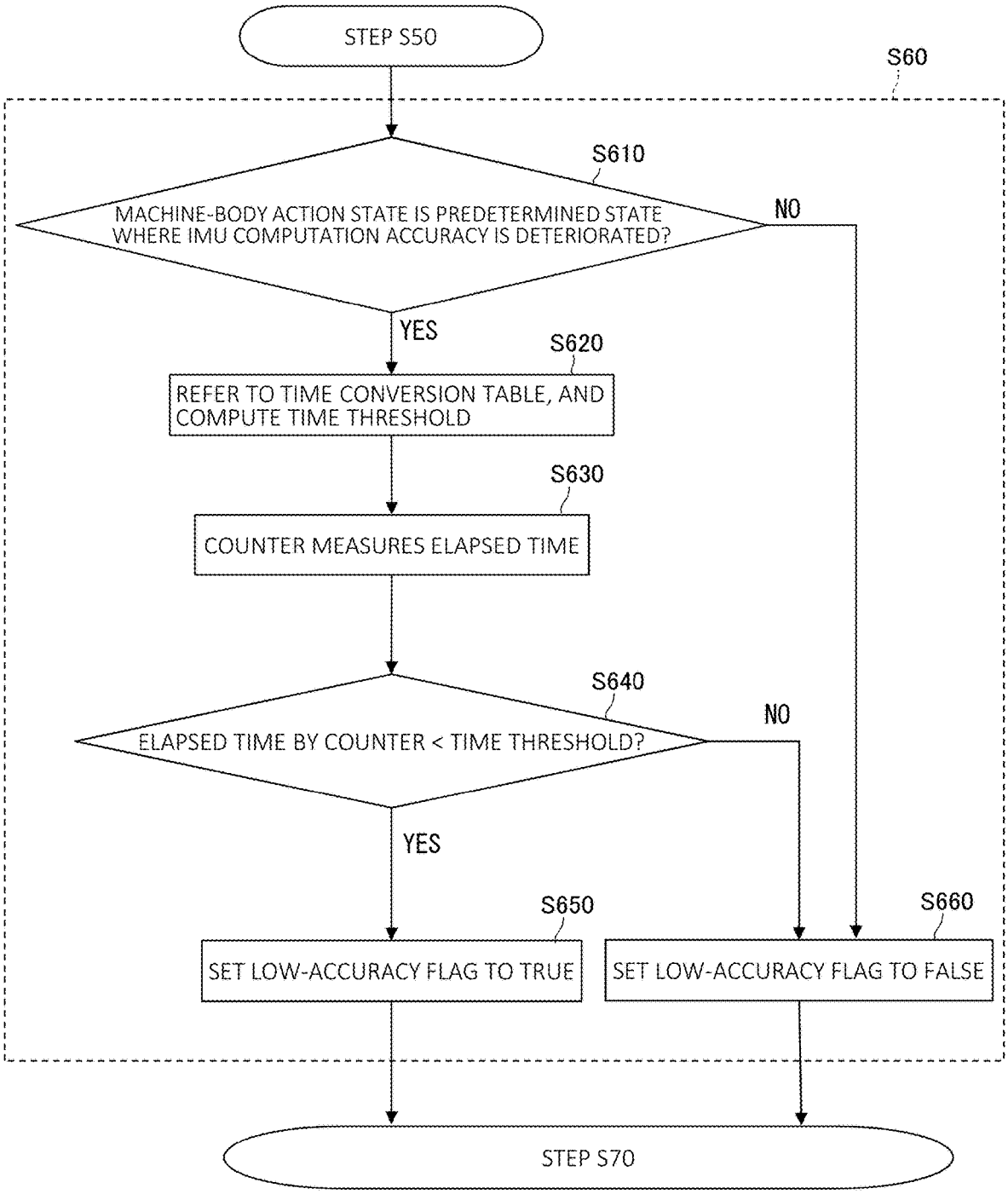
FIG. 9 is a flowchart depicting an example of a procedure of a determination about IMU computation accuracy in the flowchart depicted in FIG. 7.

Next, an example of a procedure by the positioning computing section and the monitor display control section in the controller included in the construction machine according to the first embodiment of the present invention is explained by using FIG. 4 and FIG. 7 to FIG. 9. FIG. 7 is a flowchart depicting an example of a procedure of a decision about guidance execution at the controller included in the construction machine according to the first embodiment of the present invention. FIG. 8 is a flowchart depicting an example of a procedure of a determination about a machine-body action state in the flowchart depicted in FIG. 7. FIG. 9 is a flowchart depicting an example of a procedure of a determination about IMU computation accuracy in the flowchart depicted in FIG. 7.

In FIG. 7, the positioning computing section 51 in the controller 40 depicted in FIG. 4 first takes in computation results (positions and the variance thereof) from the positioning system 35 (GNSS receiver 38), and also takes in sensing results (acceleration and angular velocities) and computation results (angles) from the IMUs 25, 26, 27, and 28 (Step S10).

Next, the posture computing section 61 in the positioning computing section 51 computes postural information on the hydraulic excavator based on the positions as computation results of the positioning system 35 and the angles as computation results of the IMUs 25, 26, 27, and 28 (Step S20).

Next, the required-angular-accuracy computing section 62 in the positioning computing section 51 determines whether or not finishing accuracy (size tolerance) as the required accuracy (first required accuracy) of information for operation assistance has been set on the required accuracy setting device 19 (Step S30). When the first required accuracy has been set (in a case of YES), the procedure proceeds to Step S40; on the other hand, when the first required accuracy has not been set (in a case of NO), the procedure proceeds to Step S90.

In a case of NO at Step S30, on the basis of postural information as a computation result of the posture computing section 61, the guidance executing section 531 in the monitor display control section 53 in the controller 40 executes guidance (Step S90). When the first required accuracy has not been set, there are no subjects to be compared with the accuracy of angle computation by the IMUs, and so it is not possible to assess whether the accuracy satisfies the required accuracy. Accordingly, in this case, the controller 40 executes functionalities of machine guidance similarly to that performed conventionally.

On the other hand, in a case of YES at Step S30, the required-angular-accuracy computing section 62 computes a required error for the accuracy of angle computation by the IMUs 25, 26, 27, and 28 (Step S40). Specifically, the required-angular-accuracy computing section 62 refers to the error conversion table 621 and computes an acceptable angular error as the second required accuracy from the size tolerance (finishing accuracy) set by the required accuracy setting device 19.

Next, the action determining section 65 in the IMU-computation-accuracy assessing section 63 in the positioning computing section 51 determines the action state of the machine body 2 and 3 (Step S50). At Step S50, in summary, on the basis of the acceleration and the angular velocities sensed by the IMUs 25, 26, 27, and 28, the action determining section 65 determines whether or not the machine body 2 and 3 is in a traveling state or a swing state.

Specifically, as depicted in FIG. 8, the action determining section 65 computes resultant acceleration based on acceleration in the three axial directions sensed by the IMUs 25, 26, 27, and 28 (Step S510). Next, the action determining section 65 determines whether or not the computed resultant acceleration is in a predetermined threshold range from the gravitational acceleration g (Step S520). This determination is equivalent to Formula 1 and Formula 2 mentioned above. When the resultant acceleration is not within the threshold range from the gravitational acceleration g at Step S520, that is, when any of Formula 1 and Formula 2 mentioned above holds true, (in a case of NO), a travel flag representing that it is determined that the action state of the machine body 2 and 3 is a traveling state is set to true (Step S530), and thereafter, the procedure proceeds to Step S540. On the other hand, when the resultant acceleration is within the threshold range from the gravitational acceleration g (in a case of YES), the procedure proceeds to Step S540 without setting the travel flag to true.

At Step S540, the action determining section 65 computes the absolute value of an angular velocity in each axial direction based on the angular velocity in each axial direction sensed by the IMUs 25, 26, 27, and 28. Next, it is determined whether or not the absolute values of the computed angular velocities are equal to or smaller than preset thresholds (biases of the angular velocity sensors) (Step S550). This determination is equivalent to Formula 3 to Formula 5 mentioned above. When the absolute value of an angular velocity is greater than the threshold at Step S550, that is, when any of Formula 3 to Formula 5 mentioned above holds true (in a case of NO), a swing flag representing that it is determined that the action state of the machine body 2 and 3 is a swing state is set to true (Step S560), and thereafter, the procedure proceeds to Step S570. On the other hand, when the absolute values of the angular velocities are equal to or smaller than the thresholds (in a case of YES), the procedure proceeds to Step S570 without setting the swing flag to true.

At Step S570, the action determining section 65 determines whether the state of the travel flag has been changed from true to false by comparing the states of the travel flag in the previous and current control cycles, and also determines whether the state of the swing flag has been changed from true to false by comparing the states of the swing flag in the previous and current control cycles. That is, it is determined whether or not the action state of the machine body 2 and 3 has changed from a traveling state to a stopped state, and also it is determined whether or not the action state has changed from a swing state to a stopped state. If the machine body 2 and 3 is in this state, this means that they are in a situation where there is a concern that the accuracy of angle computation by the IMUs deteriorates even if the machine body 2 and 3 is in a stopped state. By performing an OR operation on the determination as to whether or not there is a change of the state of the travel flag from true to false and the determination as to whether or not there is a change of the state of the swing flag from true to false, the action determining section 65 integrates, into one signal, information representing that the action state of the machine body 2 and 3 is a predetermined state that causes deterioration of the accuracy of angle computation by the IMUs 25, 26, 27, and 28. After the action determining section 65 executes the processes of Step S570, Step S50 ends.

After the end of Step S50, as depicted in FIG. 7, the IMU-computation-accuracy assessing section 63 assesses the accuracy of angle computation by the IMUs 25, 26, 27, and 28 (Step S60). At Step S60, in summary, the IMU-computation-accuracy assessing section 63 assesses whether or not the accuracy of angles as computation results of the IMUs 25, 26, 27, and 28 satisfies the second required accuracy computed at Step S40.

Specifically, as depicted in FIG. 9, the action determining section 65 determines whether or not the action state of the machine body 2 and 3 is a predetermined stopped state where the accuracy of angle computation by the IMUs has deteriorated (Step S610). That is, it is determined whether the state of the machine body 2 and 3 has changed from a traveling state to a stopped state or changed from a swing state to a stopped state. Specifically, this determination is made based on results of the determination as to whether or not there is a change of the state of the travel flag from true to false and the determination as to whether or not there is a change of the state of the swing flag from true to false.

When the action determining section 65 determines at Step S610 that the machine body 2 and 3 is in such a stopped state where the accuracy of angle computation by the IMUs deteriorates (YES), the procedure proceeds to Step S620. At Step S620, the computation accuracy determining section 66 refers to the time conversion table 661 to compute the time threshold $T_{th}$ corresponding to the acceptable angular error ea as a computation result of the required-angle computing section 62.

Next, the counter 662 in the computation accuracy determining section 66 is activated to count the elapsed time t (Step S630). This is for counting the elapsed time t since the start point at which the state of the machine body 2 and 3 has changed from a traveling state or a swing state to a stopped state.

Next, the comparing/determining section 663 in the computation accuracy determining section 66 determines whether or not the elapsed time t counted by the counter 662 is shorter than the time threshold $T_{th}$ as output of the time conversion table 661 (Step S640). This is for inspecting whether the elapsed time since when the state of the machine body 2 and 3 has changed from an active state to a stopped state has reached recovery time of IMU computation accuracy as depicted in time series data of errors of angles computed by the IMUs from the time t4 to the time t5 in the bottom diagram in FIG. 3.

When the elapsed time t of the counter is shorter than the time threshold $T_{th}$ at Step S640 (in a case of YES), the procedure proceeds to Step S650, and the comparing/determining section 663 sets, to true, the low-accuracy flag representing that the accuracy of angle computation by the IMUs 25, 26, 27, and 28 fails to satisfy the required accuracy. On the other hand, when the elapsed time t of the counter is equal to or longer than the time threshold $T_{th}$ (in a case of NO), the procedure proceeds to Step S660, and the comparing/determining section 663 sets the low-accuracy flag to false.

Meanwhile, when the action determining section 65 determines at Step S610 that the action state of the machine body 2 and 3 is not such a stopped state where IMU computation accuracy deteriorates (NO), the procedure proceeds to Step S660, and the computation accuracy determining section 66 sets the low-accuracy flag to false since determination about IMU computation accuracy is unnecessary.

After the end of Step S650 or Step S660, the process of Step S60 ends. Then, the controller 40 proceeds to a process of Step S70.

At Step S70 depicted in FIG. 7, the computation accuracy determining section 66 determines whether or not the accuracy of angle computation by the IMUs 25, 26, 27, and 28 fails to satisfy the second required accuracy. Specifically, the computation accuracy determining section 66 makes a determination on the basis of whether or not the low-accuracy flag has been set to true. When the low-accuracy flag has been set to true (in a case of YES), the procedure proceeds to Step S80. On the other hand, when the low-accuracy flag has been set to false (in a case of NO), the procedure proceeds to Step S90.

At Step S80, the guidance executing section 531 in the monitor display control section 53 stops execution of guidance. This is because, even if the machine body 2 and 3 is in a stopped state, there is a concern that a construction surface is damaged undesirably if operation assistance is performed according to inaccurate postural information based on low-accuracy computation angles of the IMUs 25, 26, 27, and 28. On the other hand, since it is determined at Step S90 that the accuracy of angle computation by the IMUs 25, 26, 27, and 28 satisfies the required accuracy, the guidance executing section 531 in the monitor display control section 53 executes guidance.

After the process of Step S80 or Step S90 is executed, the controller 40 returns to the start. The positioning computing section 51 and the monitor display control section 53 repeatedly execute again and again the control cycle including the set of Steps S10 to S90 as one cycle, to thereby execute or stop machine guidance, which is one type of operation assistance.

In this manner, the controller 40 according to the present embodiment can inhibit use of inaccurate postural information during execution of the machine guidance, by determining whether or not the machine body 2 and 3 is in such a predetermined stopped state where the computation accuracy of the IMUs 25, 26, 27, and 28 deteriorates, and taking a negative measure against work assistance such as stopping execution of machine guidance or giving a warning when the machine body 2 and 3 is in the predetermined stopped state.

As mentioned above, the hydraulic excavator (construction machine) according to the first embodiment of the present invention includes the machine body 2 and 3, the front work implement 1 (work implement) attached pivotably to the machine body 2 and 3, the IMUs 25, 26, 27, and 28 (angle measuring apparatus) that are installed on the machine body 2 and 3 and the front work implement 1 (work implement), that sense acceleration and angular velocities of the installation portions, and that perform angle computation of computing angles of the installation portions relative to the reference plane on the basis of sensing results, and the controller 40 that computes postural information representing the postures of the machine body 2 and 3 and the front work implement 1 (work implement) on the basis of the angles computed by the IMUs 25, 26, 27, and 28 (angle measuring apparatus), that displays the computed postural information on the monitor 19 (display device), and that executes operation assistance of the front work implement 1 (work implement) on the basis of the computed postural information. The controller 40 is configured to perform required accuracy computation of computing the second required accuracy which is accuracy required for angle computation by the IMUs 25, 26, 27, and 28 (angle measuring apparatus) on the basis of the first required accuracy which is required accuracy set for information used for operation assistance of the front work implement 1 (work implement), make an action stop determination of determining whether or not the state of the machine body 2 and 3 has changed from an active state to a stopped state on the basis of the sensing results of the IMUs 25, 26, 27, and 28 (angle measuring apparatus), make an accuracy determination of determining whether or not the accuracy of angle computation by the IMUs 25, 26, 27, and 28 (angle measuring apparatus) satisfies the second required accuracy, and stop operation assistance of the front work implement 1 (work implement) or give a warning in a case where it is determined that the state of the machine body has changed from an active state to a stopped state, and where it is determined that the accuracy of angle computation by the IMUs 25, 26, 27, and 28 (angle measuring apparatus) fails to satisfy the second required accuracy.

According to this configuration, the controller 40 stops the operation assistance of the front work implement 1 (work implement) such as machine guidance or machine control or gives a warning in a case where the accuracy of angle computation by the IMUs 25, 26, 27, and 28 (angle measuring apparatus) fails to satisfy the required accuracy even if the machine body 2 and 3 is in a stopped state, and so it is possible to inhibit use of inaccurate postural information during execution of the operation assistance of the front work implement 1 (work implement).

In addition, the accuracy determination by the controller 40 according to the present embodiment is made by setting the time threshold $T_{th}$ from the second required accuracy computed by the required accuracy computation, with use of the time conversion table 661 (conversion table) specified in advance such that the time threshold $T_{th}$ increases as the second required accuracy rises, counting the elapsed time t since a time at which it is determined in the action stop determination that the state of the machine body 2 and 3 has changed from an active state to a stopped state, and comparing the counted elapsed time t with the set time threshold $T_{th}$. In the accuracy determination, it is determined that the accuracy of angle computation by the IMUs 25, 26, 27, and 28 (angle measuring apparatus) fails to satisfy the second required accuracy when the counted elapsed time t is shorter than the set time threshold $T_{th}$.

According to this configuration, without using computation results of the IMUs 25, 26, 27, and 28 (angle measuring apparatus), the accuracy of angle computation by the IMUs 25, 26, 27, and 28 (angle measuring apparatus) can be assessed on the basis of the elapsed time t since the time at which transition of the state of the machine body 2 and 3 to an action stop has been completed, with use of the conversion table specified in advance on the basis of experiment data or the like.

Modification Example of First Embodiment

Figure 10:
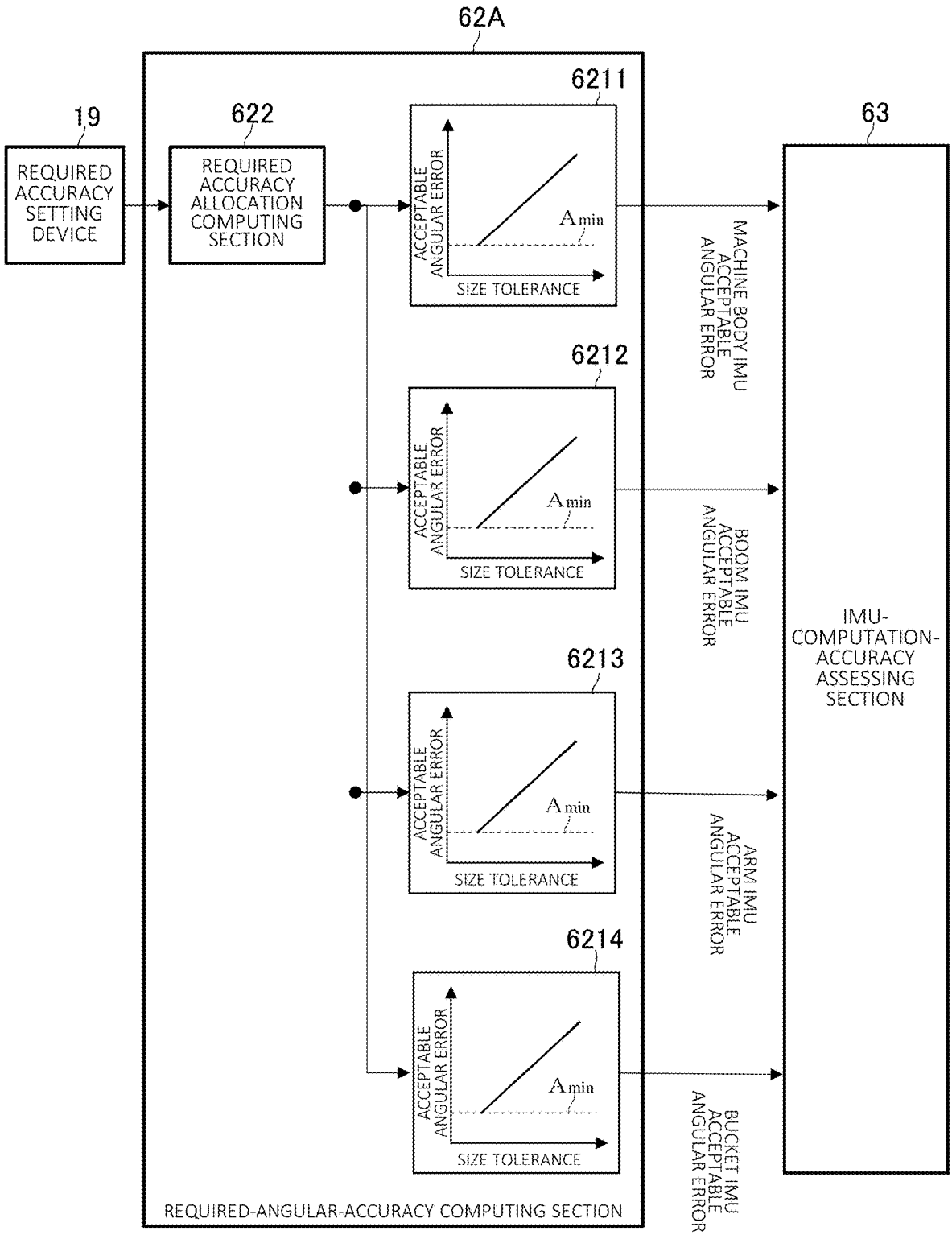
FIG. 10 is a block diagram depicting a functional configuration of a required-angular-accuracy computing section included as part of a positioning computing section in a controller according to a construction machine according to a modification example of the first embodiment of the present invention.

Next, a construction machine according to a modification example of the first embodiment of the present invention is explained by using FIG. 10. FIG. 10 is a block diagram depicting a functional configuration of a required-angular-accuracy computing section included as part of the positioning computing section in the controller of the construction machine according to the modification example of the first embodiment of the present invention. Note that portions in FIG. 10 that are given the same reference characters as reference characters of their counterparts depicted in FIG. 1 to FIG. 9 are similar portions, and so detailed explanations thereof are omitted.

The modification example of the first embodiment of the construction machine according to the present invention is different from the first embodiment in that a required-angular-accuracy computing section 62A in the positioning computing section 51 in the controller 40 has a different functional configuration. The required-angular-accuracy computing section 62 according to the first embodiment outputs one acceptable angular error (second required accuracy) for one size tolerance (first required accuracy) input on the required accuracy setting device 19 (see FIG. 5). In contrast, as depicted in FIG. 10, the required-angular-accuracy computing section 62A according to the modification example of the first embodiment includes four error conversion tables 6211, 6212, 6213, and 6214 respectively corresponding to the IMUs 25, 26, 27, and 28 installed on the upper swing structure 3, the boom 6, the arm 7, and the bucket 8, and a required accuracy allocation computing section 622 that allocates a size tolerance (finishing accuracy as the first required accuracy) set by the required accuracy setting device 19 on the basis of a relation specified in advance for the error conversion tables 6211, 6212, 6213, and 6214 corresponding to the IMUs 25, 26, 27, and 28.

Since the boom 6 of the hydraulic excavator typically has a lengthwise dimension which is greater than that of the bucket 8, even if errors (accuracy) of angle computation by the IMUs 25, 26, 27, and 28 have the same value, those errors have different degrees of influence on computation of positional information on the claw tip of the bucket. For example, if the accuracy of angle computation by the boom IMU 26 deteriorates by 0.5 degrees, this creates a 5-cm change in a computation result of the claw-tip position of the bucket 8. Even if the accuracy of angle computation by the bucket IMU 28 deteriorates by 0.5 degrees, this creates only a 1-cm change in a computation result of the claw-tip position. The required-angular-accuracy computing section 62A according to the modification example of the first embodiment takes this into consideration, and is configured to set errors (accuracy) of angle computation by the machine-body IMU 25 and the boom IMU 26 which are related to computation of a relative angle of the boom 6 such that they are different from errors (accuracy) of angle computation by the arm IMU 27 and the bucket IMU 28 which are related to computation of a relative angle of the bucket 8.

Similarly to the error conversion table 621 in the required-angular-accuracy computing section 62 according to the first embodiment depicted in FIG. 5, the first to fourth error conversion tables 6211, 6212, 6213, and 6214 for the IMUs 25, 26, 27, and 28 are used to convert a margin of size error (size tolerance) input on the required accuracy setting device 19 into a margin of angular error (acceptable angular error). It should be noted that the values of size tolerances input according to computation results of the required accuracy allocation computing section 622 are different in the first to fourth conversion tables 6211, 6212, 6213, and 6214.

The required accuracy allocation computing section 622 allocates finishing accuracy, that is, a size tolerance, set by the required accuracy setting device 19 to the boom 6, the arm 7, and the bucket 8 included in the front work implement 1. It is desirable if this allocation is set according to the sizes of the constituent members 6, 7, and 8 of the front work implement 1. For example, in a case where finishing accuracy set by the required accuracy setting device 19 is 10 cm, the required accuracy allocation computing section 622 respectively allocates 5 cm, 3 cm, and 2 cm to the boom part, the arm part, and the bucket part according to the size ratio of the three constituent members 6, 7, and 8. The required accuracy allocation computing section 622 outputs the size tolerances allocated to the parts to the error conversion tables 6211, 6212, 6213, and 6214 corresponding to the parts. With this, the error conversion tables 6211, 6212, 6213, and 6214 each calculate the acceptable angular errors for the IMUs 25, 26, 27, and 28.

An error of the boom part depends on the accuracy of angle computation by the machine-body IMU 25 and the boom IMU 26. Hence, reference values of the first and second error conversion tables 6211 and 6212 are decided by the error of the boom part. An error of the arm part depends on the accuracy of the boom IMU 26 and the arm IMU 27, but can be decided only by the accuracy of the arm IMU 27 since the acceptable angular error of the boom IMU 26 is decided already. An error of the bucket part also can be decided only by the accuracy of the bucket IMU 28 similarly to the error of the arm part.

According to the construction machine according to the modification example of the first embodiment of the present invention mentioned above, similarly to the first embodiment mentioned before, the controller 40 stops operation assistance of the front work implement 1 (work implement) or gives a warning when the accuracy of angle computation by the IMUs 25, 26, 27, and 28 (angle measuring apparatus) fails to satisfy the required accuracy even if the machine body 2 and 3 is in a stopped state, and so it is possible to inhibit use of inaccurate postural information during execution of the operation assistance of the front work implement 1 (work implement).

In addition, the required accuracy computation by the controller 40 in the present modification example allocates, to the IMUs 25, 26, 27, and 28, size tolerances as the first required accuracy according to the degrees of influence on information for operation assistance of the front work implement 1 (information on the tip position of the bucket 8) by postural information of the constituent members 6, 7, and 8, and computes acceptable angular errors as the second required accuracy of angle computation by the IMUs 25, 26, 27, and 28 from the size tolerances allocated to the IMUs 25, 26, 27, and 28, with use of the error conversion tables 6211, 6212, 6213, and 6214 of the IMUs 25, 26, 27, and 28 which tables are specified in advance such that acceptable angular errors increase as size tolerances increase.

According to this configuration, by changing the values of size tolerances (first required accuracy) according to the degrees of influence by postural information of the constituent members 6, 7, and 8 on information for operation assistance of the front work implement 1 (information on the tip position of the bucket 8), the required accuracy (second required accuracy) of angle computation by the IMUs 25, 26, 27, and 28 can be changed according to the degrees of influence on the information for the operation assistance of the front work implement 1 (the information on the tip position of the bucket 8), and so it is possible to further inhibit use of inaccurate postural information during execution of the operation assistance of the front work implement 1.

Second Embodiment

Figure 11:
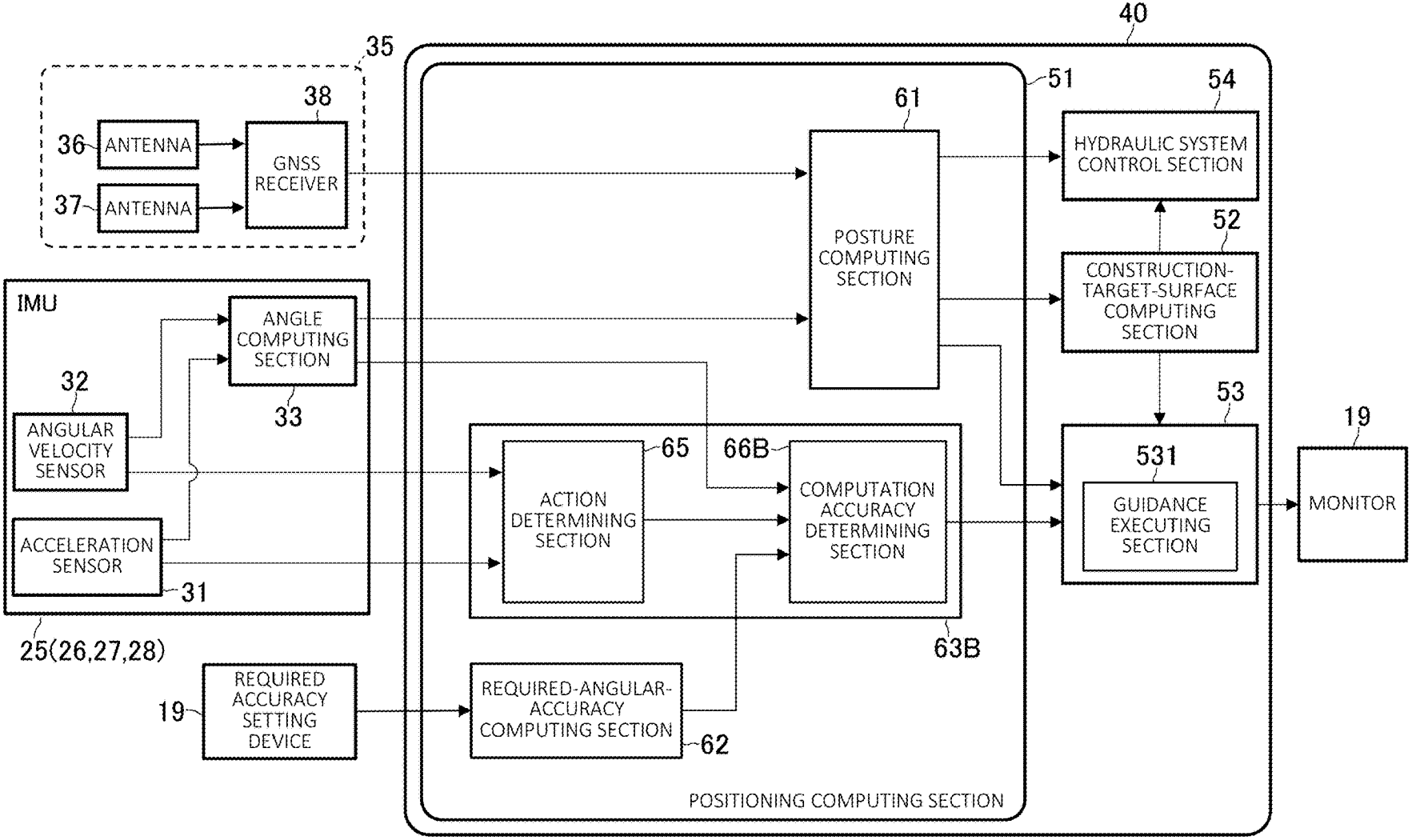
FIG. 11 is a block diagram depicting a functional configuration of a controller in a construction machine according to a second embodiment of the present invention.
Figure 12:
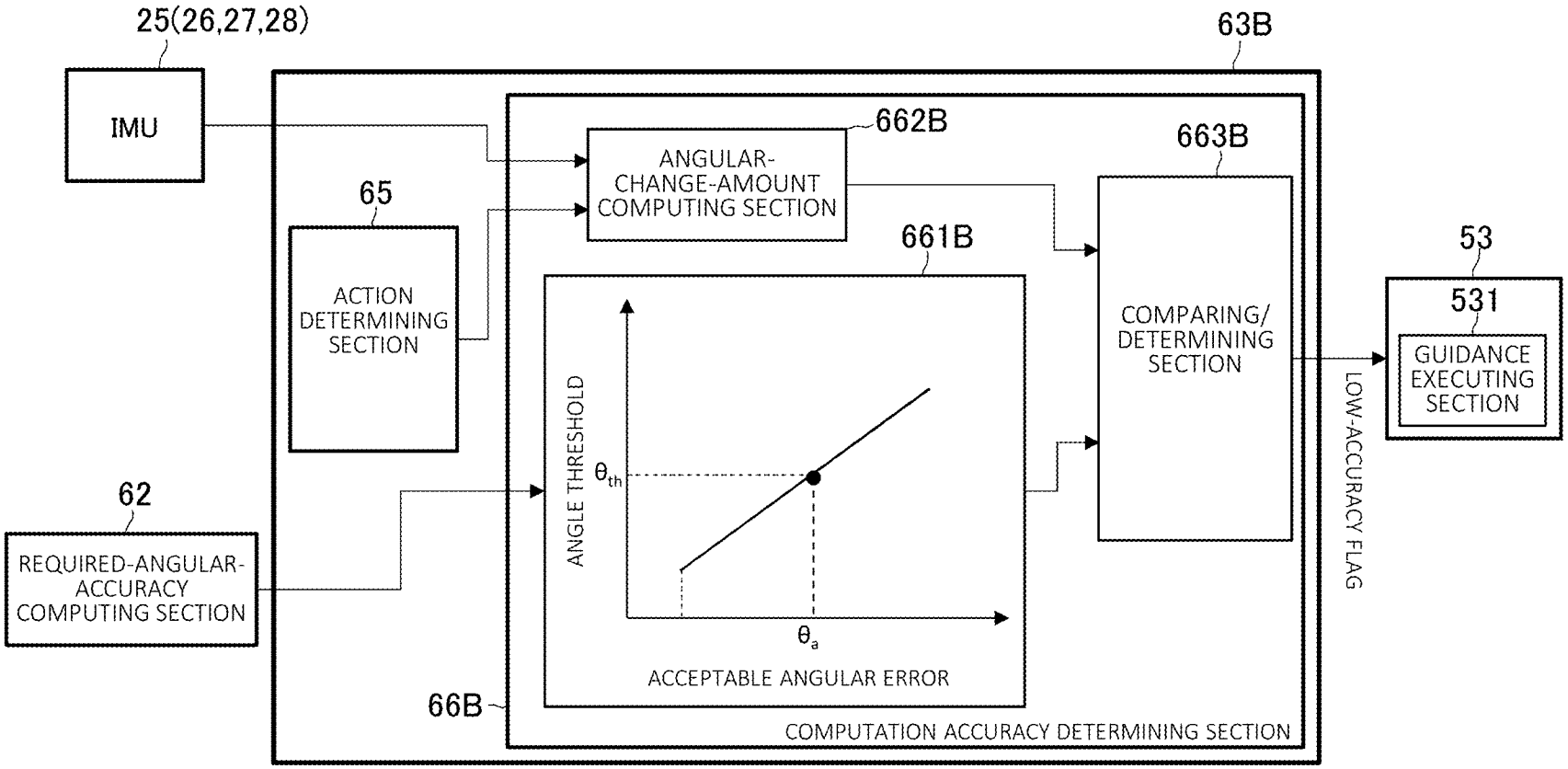
FIG. 12 is a block diagram depicting a functional configuration of an IMU-computation-accuracy assessing section included as part of the positioning computing section in the controller depicted in FIG. 11.
Figure 13:
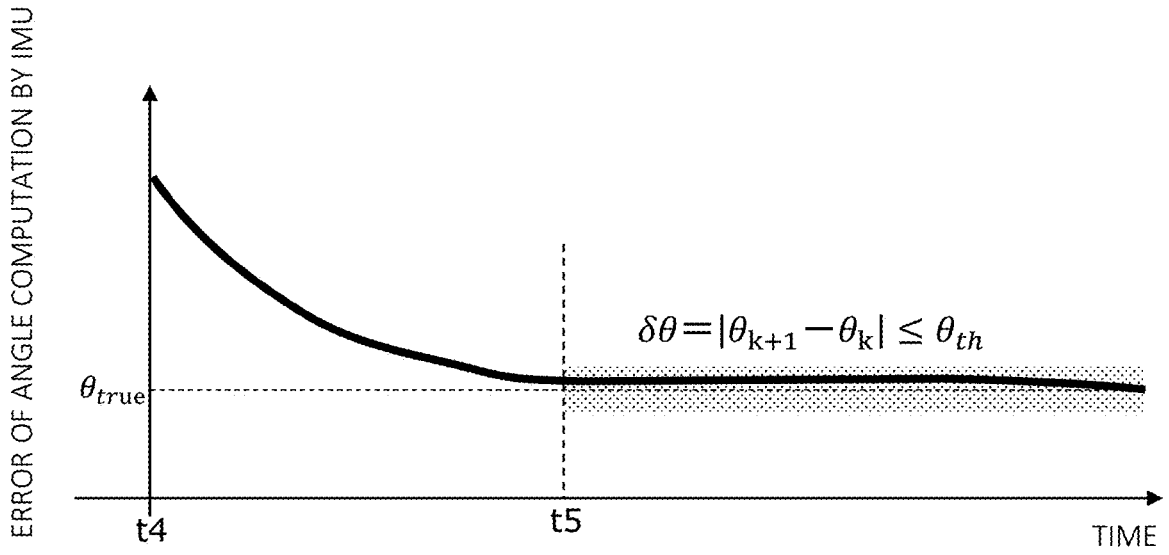
FIG. 13 is an explanatory diagram depicting a method of accuracy assessment by the IMU-computation-accuracy assessing section in the controller in the construction machine according to the second embodiment of the present invention depicted in FIG. 12.
Figure 14:
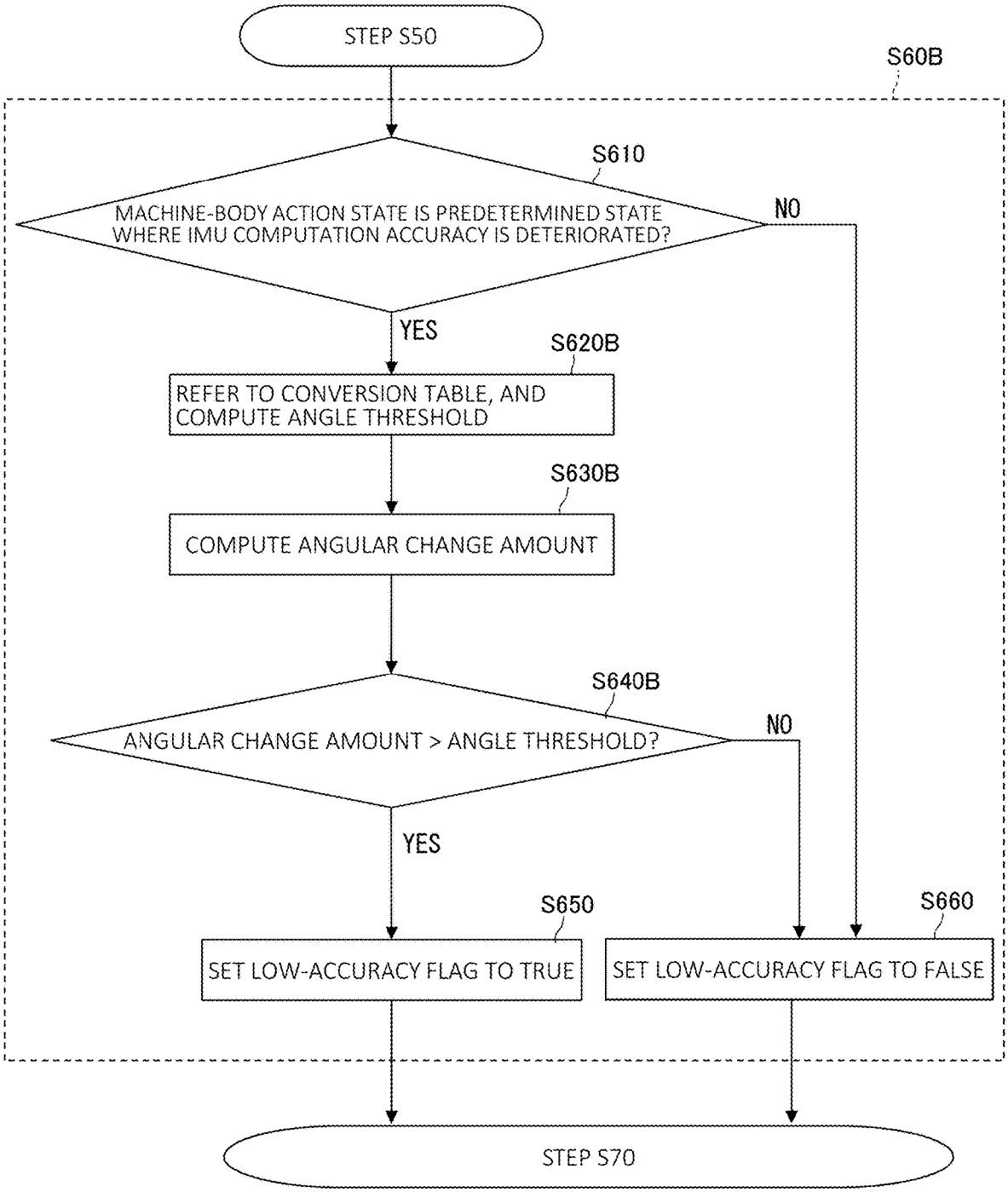
FIG. 14 is a flowchart depicting an example of a procedure by the IMU-computation-accuracy assessing section in the controller in the construction machine according to the second embodiment of the present invention depicted in FIG. 12.

Next, a construction machine according to a second embodiment of the present invention is explained by using FIG. 11 to FIG. 14. FIG. 11 is a block diagram depicting a functional configuration of the controller in the construction machine according to the second embodiment of the present invention. FIG. 12 is a block diagram depicting a functional configuration of an IMU-computation-accuracy assessing section included as part of the positioning computing section in the controller depicted in FIG. 11. FIG. 13 is an explanatory diagram depicting a method of accuracy assessment at the IMU-computation-accuracy assessing section in the controller in the construction machine according to the second embodiment of the present invention depicted in FIG. 12. FIG. 14 is a flowchart depicting an example of a procedure by the IMU-computation-accuracy assessing section in the controller in the construction machine according to the second embodiment of the present invention depicted in FIG. 12. Note that portions in FIG. 11 to FIG. 14 that are given the same reference characters as reference characters of their counterparts depicted in FIG. 1 to FIG. 10 are similar portions, and so detailed explanations thereof are omitted.

The second embodiment of the construction machine according to the present invention depicted in FIG. 11 and FIG. 12 is different from the first embodiment in that a computation accuracy determining section 66B in an IMU-computation-accuracy assessing section 63B of the positioning computing section 51 of the controller 40 has a different functional configuration.

The computation accuracy determining section 66 according to the first embodiment uses the time conversion table 661 representing the relation between errors (accuracy) of angles computed by the IMUs 25, 26, 27, and 28 and time required for the errors to reach a range of an acceptable angular error, by acquiring in advance time series data of errors (accuracy) of angles computed by the IMUs after the state of the machine body 2 and 3 has changed from an active state to a stopped state (see FIG. 6). The computation accuracy determining section 66 compares the elapsed time t since the state of the machine body 2 and 3 has changed from an active state to a stopped state with the time threshold $T_{th}$ set by referring to the time conversion table 661 to determine whether the computation accuracy of the IMUs 25, 26, 27, and 28 satisfies the required accuracy (see FIG. 6). Realization of the first embodiment requires separate acquisition of experiment data like the one depicted in the bottom diagram in FIG. 3, and so implementation of the functionality in the controller requires a large number of man-hours.

In contrast, the computation accuracy determining section 66B according to the second embodiment uses angles as computation results of the IMUs 25, 26, 27, and 28 as depicted in FIG. 11 and FIG. 12 to determine whether the accuracy of angle computation by the IMUs 25, 26, 27, and 28 satisfies the required accuracy. Specifically, as depicted in FIG. 12, in addition to the action determining section 65 similar to that in the first embodiment, the computation accuracy determining section 66B includes an angle threshold conversion table 661B which is used to set an angle threshold $\theta_{th}$ as the comparison subject of accuracy determination on the basis of the second required accuracy (acceptable angular error) as a computation result of the required-angular-accuracy computing section 62, an angular-change-amount computing section 662B that computes a temporal change amount $\delta\theta$ of angles as computation results of the IMUs 25, 26, 27, and 28, and a comparing/determining section 663B that determines whether or not the accuracy of angle computation by the IMUs 25, 26, 27, and 28 satisfies the second required accuracy by comparing the temporal change amount $\delta\theta$ of the angles computed by the angular-change-amount computing section 662B with the angle threshold $\theta_{th}$ output by the angle threshold conversion table 661B. The computation accuracy determining section 66B is realized on the basis of the following contents.

FIG. 13 is an enlarged view of errors of angle computation by the IMUs at and after the time t4 in the bottom diagram in FIG. 3. When the machine body is in a stopped state, an angle as a computation result of the IMUs keeps assuming a certain value $\theta_{true}$ influenced by biases of the IMUs. It should be noted that, since errors of angle computation by the IMUs during active time of the machine body are accumulated immediately after the state of the machine body has changed from an active state to a stopped state, the angle as a computation result of the IMUs assumes a value not matching the predetermined value $\theta_{true}$ Since a stopped state of the machine body continues at and after the time t4, the angle as a computation result of the IMUs gradually approaches the predetermined value $\theta_{true}$, and errors of angle computation by the IMU also gradually decrease. At and after the time t5, the angle output by the IMUs substantially matches the predetermined value $\theta_{true}$.

Here, attention is paid to the change amount $\delta\theta$ of an angle $\theta$ as a computation result of the IMUs. $\delta\theta$ is the absolute value of a difference between an angle $\theta_k$ as a computation result of the IMUs at a certain time k and an angle $\theta_{k+1}$ as a computation result of the IMUs at the next time k+1. That is, $\delta\theta=|\theta_{k+1}-\theta_k|$. As depicted in FIG. 13, data representing that the change amount $\delta\theta$ is equal to or smaller than a predetermined value $\theta_{th}$ at and after the time t5 can be obtained. From this fact, it is possible to determine that, when $\delta\theta=|\theta_{k+1}-\theta_k|\leq\theta_{th}$, the accuracy of angle computation by the IMUs is not low.

The angle threshold conversion table 661B is used to set the angle threshold $\theta_{th}$ as a reference value for determining whether or not the angular change amount $\delta\theta$ in angle computation by the IMUs has converged. The angle threshold conversion table 661B specifies the relation of the angle threshold $\theta_{th}$ corresponding to the acceptable angular error $\theta_a$ as the second required accuracy which is a computation result of the required-angular-accuracy computing section 62. The relation of the angle threshold $\theta_{th}$ with an acceptable angular error $\theta_A$ in the angle threshold conversion table 661B has characteristics that, as the acceptable angular error increases (the second required accuracy lowers), the angle threshold increases, and, on the other hand, as the acceptable angular error decreases (the second required accuracy rises), the angle threshold decreases. In response to input of an acceptable angular error as a computation result of the required-angular-accuracy computing section 62, the angle threshold conversion table 661B outputs an angle threshold to the comparing/determining section 663B.

The angular-change-amount computing section 662B computes the temporal change amount $\delta\theta$ of the angle which is the absolute value of the difference between the angle $\theta_{k+1}$ as a computation result of the IMUs 25, 26, 27, and 28 taken in at the time k+1 and the angle $\theta_k$ as a computation result of the IMUs 25, 26, 27, and 28 taken in at the preceding time k. As mentioned above, the angular change amount $\delta\theta$ serves as an index representing whether or not the computation accuracy of the IMUs 25, 26, 27, and 28 satisfies the required accuracy. When the action determining section 65 determines that the state of the machine body 2 and 3 has changed from an active state to a stopped state (at the same timing as activation of the counter 662 in the computation accuracy determining section 66 in the first embodiment), the angular-change-amount computing section 662B starts computation of the angular change amount $\delta\theta$. The angular-change-amount computing section 662B outputs the computed angular change amount $\delta\theta$ to the comparing/determining section 663B.

The comparing/determining section 663B determines whether or not the accuracy of angle computation by the IMUs 25, 26, 27, and 28 satisfies the second required accuracy as a computation result of the required-angular-accuracy computing section 62, by comparing the angular change amount 60 computed by the angular-change-amount computing section 662B with the angle threshold $\theta_{th}$ output by the angle threshold conversion table 661B. When the angular change amount $\delta\theta$ of the angular-change-amount computing section 662B is greater than the angle threshold $\theta_{th}$ in the angle threshold conversion table 661B, the comparing/determining section 663B determines that the accuracy of angle computation by the IMUs 25, 26, 27, and 28 fails to satisfy the second required accuracy, and sets the low-accuracy flag to true. On the other hand, when the angular change amount 60 is equal to or smaller than the angle threshold $\theta_{th}$, it is determined that the accuracy of angle computation by the IMUs 25, 26, 27, and 28 satisfies the second required accuracy, and the low-accuracy flag is set to false.

Next, an example of a procedure by the IMU-computation-accuracy assessing section 63B according to the second embodiment is explained. Instead of Step S60 (see FIG. 9), which is a process of assessing the accuracy of angle computation by the IMUs 25, 26, 27, and 28 performed by the IMU-computation-accuracy assessing section 63 in the first embodiment, Step S60B depicted in FIG. 14 is executed.

Specifically, when the action determining section 65 determines, at Step S610 which is similar to the case of the first embodiment, that the machine body 2 and 3 is in such a stopped state where the accuracy of angle computation by the IMUs deteriorates (YES), the procedure proceeds to Step S620B. At Step S620B, the computation accuracy determining section 66 refers to the angle threshold conversion table 661B to compute the angle threshold $\theta_{th}$ corresponding to the acceptable angular error $\theta_A$ as a computation result of the required-angle computing section 62.

Next, the angular-change-amount computing section 662B in the computation accuracy determining section 66 computes the angular change amount $\delta\theta$ (Step S630B). This is for starting computation from when the state of the machine body 2 and 3 has changed from a traveling state or a swing state to a stopped state.

Next, the comparing/determining section 663B in the computation accuracy determining section 66 determines whether or not the angular change amount $\delta\theta$ computed by the angular-change-amount computing section 662B is greater than the angle threshold $\theta_{th}$ as output of the angle threshold conversion table 661B (Step S640B). This is for inspecting whether the state of the machine body 2 and 3 has changed to a stopped state and angles computed by the IMUs have converged to be close to a predetermined value, as represented by time series data of errors of angles computed by the IMUs at and after the time t5 in FIG. 13.

When the angular change amount $\delta\theta$ is greater than the angle threshold $\theta_{th}$ (in a case of YES) at Step S640B, the procedure proceeds to Step S650, and the comparing/determining section 663B sets the low-accuracy flag to true. On the other hand, when the angular change amount $\delta\theta$ is equal to or smaller than the angle threshold $\theta_{th}$ (in a case of NO), the procedure proceeds to Step S660, and the comparing/ determining section 663B sets the low-accuracy flag to false. After the end of Step S650 or Step S660, the process of Step S60B ends.

According to the second embodiment of the construction machine according to the present invention mentioned above, similarly to the first embodiment mentioned before, the controller 40 stops operation assistance of the front work implement 1 (work implement) or gives a warning when the accuracy of angle computation by the IMUs 25, 26, 27, and 28 (angle measuring apparatus) fails to satisfy the required accuracy even if the machine body 2 and 3 is in a stopped state, and so it is possible to inhibit use of inaccurate postural information during execution of the operation assistance of the front work implement 1 (work implement).

In addition, the accuracy determination by the controller 40 according to the present embodiment is made by setting the angle threshold $\theta_{th}$ from the second required accuracy computed by the required accuracy computation with use of the angle threshold conversion table 661B that is specified in advance such that the angle threshold $\theta_{th}$ decreases as the second required accuracy rises, computing the temporal change amount $\delta\theta$ of the angle computed by the IMUs 25, 26, 27, and 28 (angle measuring apparatus), and comparing the computed angular temporal change amount $\delta\theta$ with the set angle threshold $\theta_{th}$. In the accuracy determination, it is determined that the accuracy of angle computation by the IMUs 25, 26, 27, and 28 (angle measuring apparatus) fails to satisfy the second required accuracy when the computed angular temporal change amount $\delta\theta$ is greater than the set angle threshold $\theta_{th}$.

According to this configuration, as compared to the case of the first embodiment in which the conversion table for setting a threshold as the comparison subject of accuracy determination about angle computation by the IMUs 25, 26, 27, and 28 (angle measuring apparatus) is one that is specified on the basis of experiment data acquired by using expensive sensors, the angle threshold conversion table 661B for setting a threshold as the comparison subject of accuracy determination can be specified without acquiring experiment data in advance, and so implementation in the controller 40 does not require a large number of man-hours.

Third Embodiment

Figure 15:
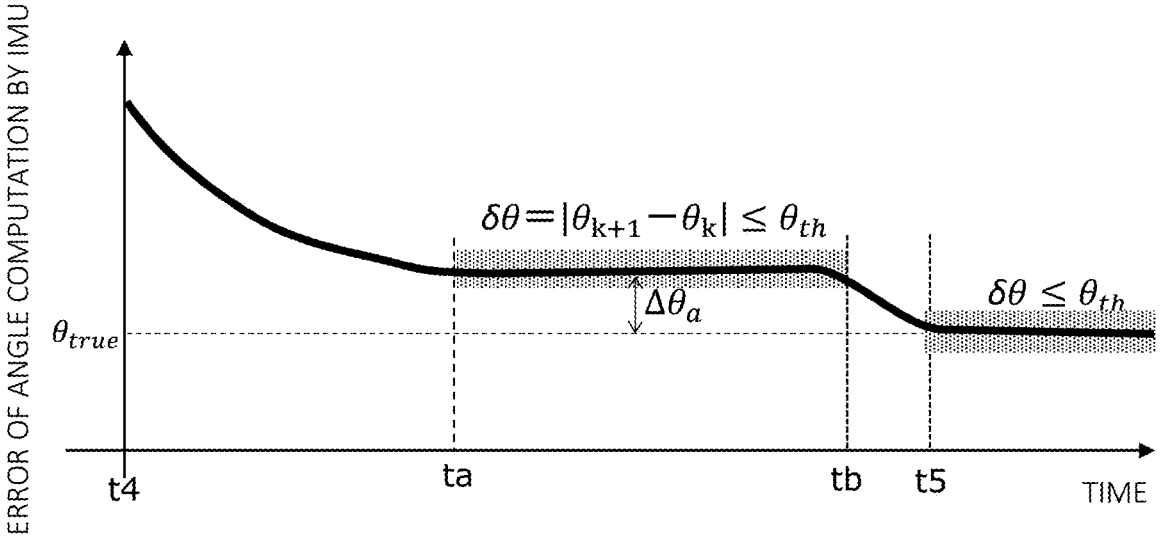
FIG. 15 is an explanatory diagram depicting a problem in the construction machine according to the second embodiment of the present invention.
Figure 16:
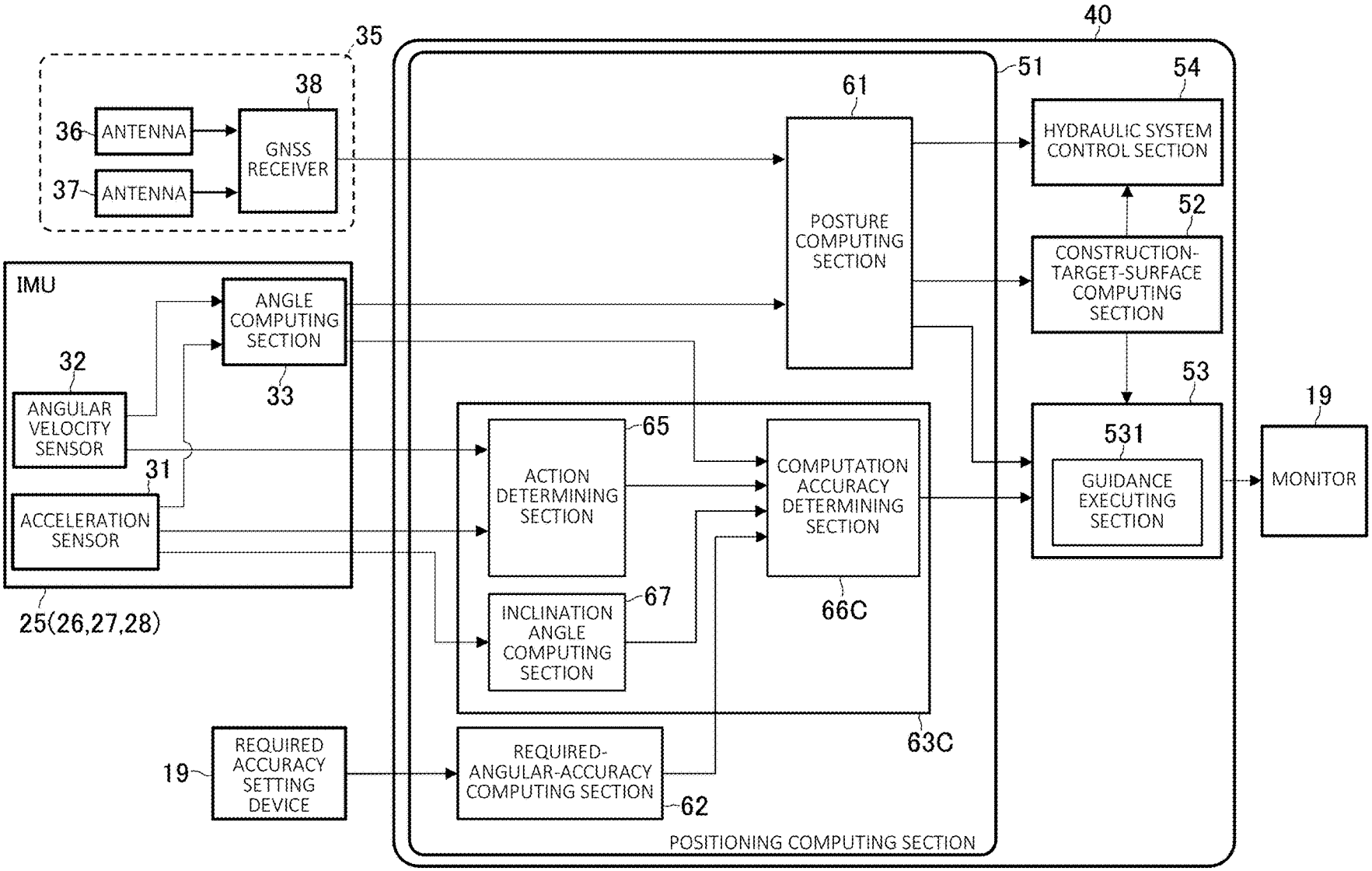
FIG. 16 is a block diagram depicting a functional configuration of a controller in a construction machine according to a third embodiment of the present invention.
Figure 17:
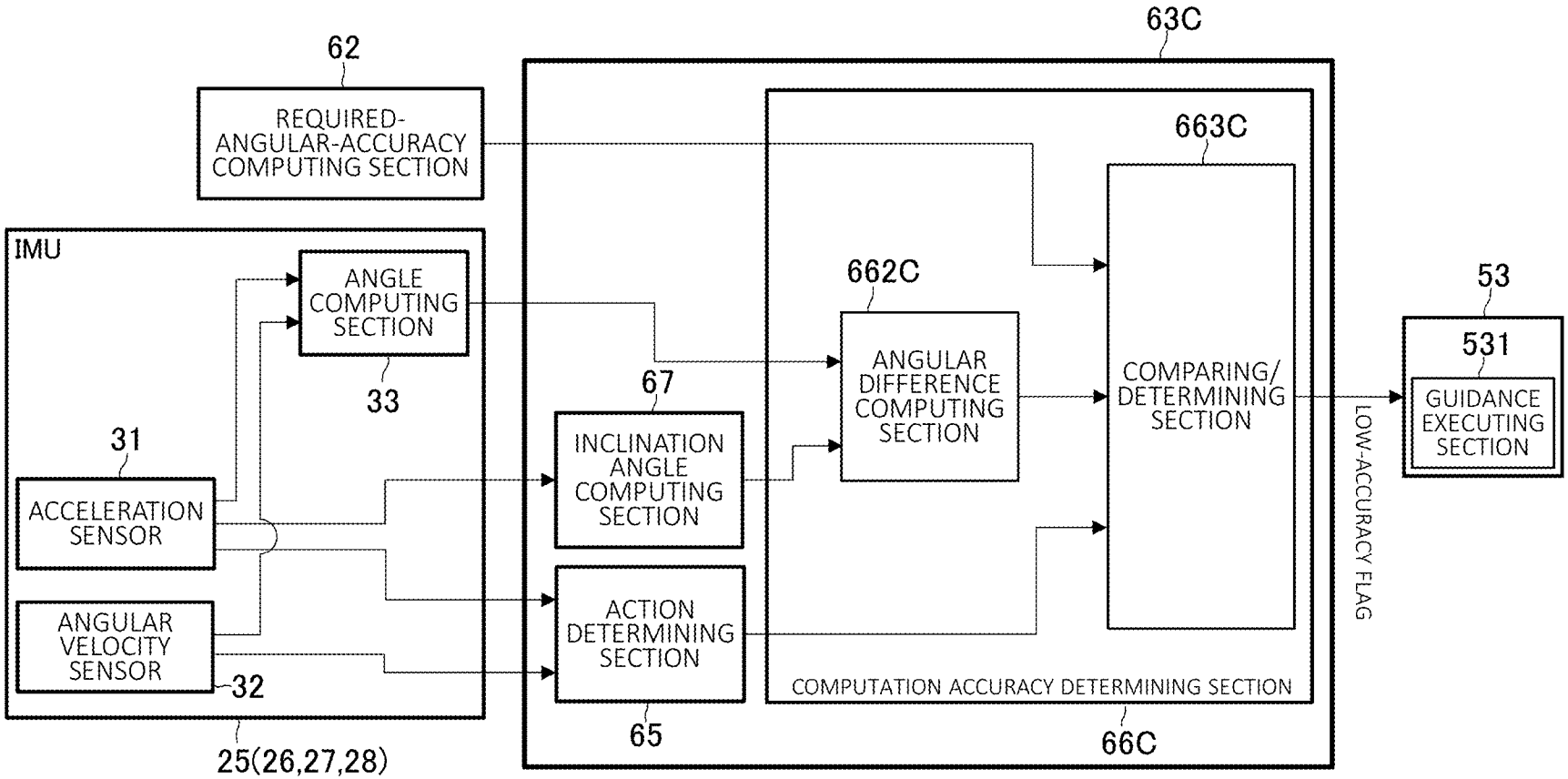
FIG. 17 is a block diagram depicting a functional configuration of an IMU-computation-accuracy assessing section included as part of the positioning computing section in the controller depicted in FIG. 16.
Figure 18:
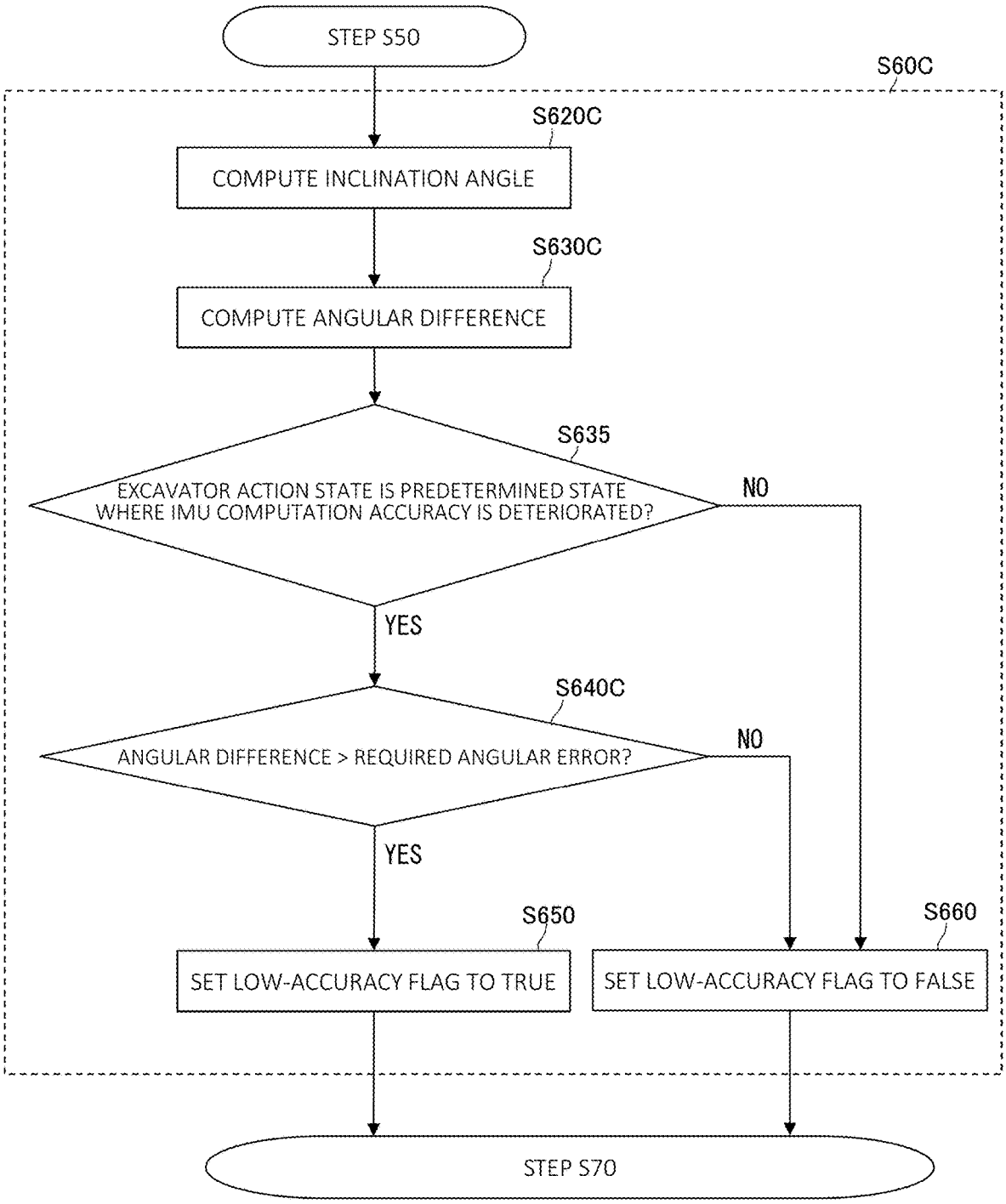
FIG. 18 is a flowchart depicting an example of a procedure by the IMU-computation-accuracy assessing section in the controller in the construction machine according to the second embodiment of the present invention depicted in FIG. 17.
Figure 19:
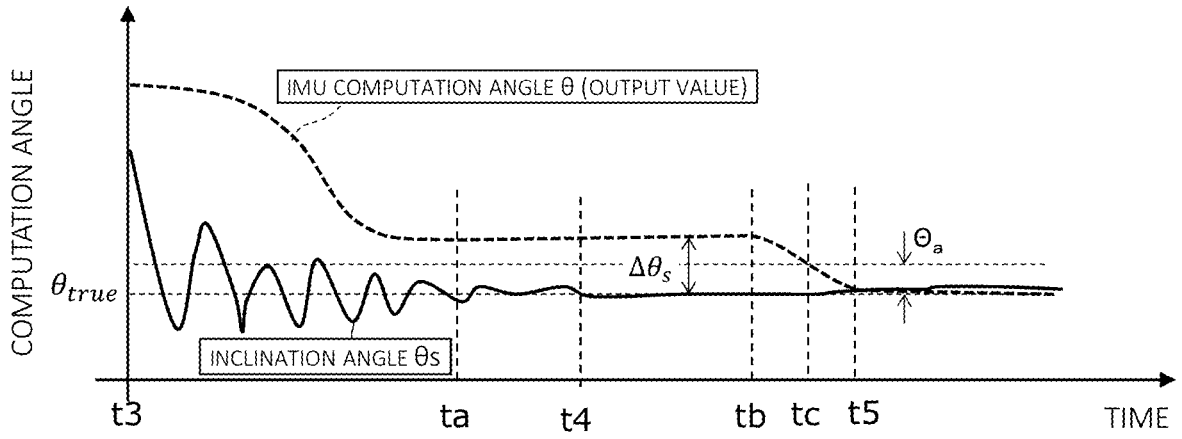
FIG. 19 is an explanatory diagram depicting effects and advantages of the construction machine according to the third embodiment of the present invention.

Next, a construction machine according to a third embodiment of the present invention is explained by using FIG. 15 to FIG. 19. FIG. 15 is an explanatory diagram depicting a problem in the construction machine according to the second embodiment of the present invention. FIG. 16 is a block diagram depicting a functional configuration of the controller in the construction machine according to the third embodiment of the present invention. FIG. 17 is a block diagram depicting a functional configuration of an IMU-computation-accuracy assessing section included as part of the positioning computing section in the controller depicted in FIG. 16. FIG. 18 is a flowchart depicting an example of a procedure by the IMU-computation-accuracy assessing section in the controller of the construction machine according to the third embodiment of the present invention depicted in FIG. 17. FIG. 19 is an explanatory diagram depicting effects and advantages of the construction machine according to the third embodiment of the present invention. Note that portions in FIG. 15 to FIG. 19 that are given the same reference characters as reference characters of their counterparts depicted in FIG. 1 to FIG. 14 are similar portions, and so detailed explanations thereof are omitted.

The IMU-computation-accuracy assessing section 63B in the second embodiment assesses the accuracy of angle computation by the IMUs 25, 26, 27, and 28 based on temporal change amount $\delta\theta$ of an angle as a computation result of the IMUs 25, 26, 27, and 28. However, there is a concern that an error occurs in the assessment of the computation accuracy depending on the computation characteristics of the IMUs. An example of such cases is a case where the computation characteristics of the IMUs are like the characteristics depicted in FIG. 15. The angle $\theta$ as a computation result (output value) of the IMUs does not monotonically approach the predetermined value $\theta_{true}$, the temporal change of the angle $\theta$ temporarily stops from a time ta to a time tb, and thereafter, the angle $\theta$ substantially matches the predetermined value $\theta_{true}$ at and after the time t5. In such a case, in the second embodiment, the IMU-computation-accuracy assessing section 63B in the controller 40 undesirably determines that the computation accuracy of the IMUs 25, 26, 27, and 28 satisfies the required accuracy since the temporal change amount $\delta\theta$ of the angle is equal to or smaller than the angle threshold $\theta_{th}$ from the time ta to the time tb. However, at this time, the computation accuracy of the IMUs 5, 26, 27, and 28 fails to satisfy the required accuracy in some cases since the angle as a computation result of the IMUs 25, 26, 27, and 28 has an error of $\Delta\theta_a$ relative to the predetermined value $\theta_{true}$.

In view of this, in the third embodiment, assessment of IMU computation accuracy is performed with fewer errors of determination by simple computation, while the advantage of the second embodiment that prior acquisition of experiment data by using expensive sensors is unnecessary is maintained. The third embodiment of the construction machine according to the present invention depicted in FIG. 16 is different from the second embodiment in that an IMU-computation-accuracy assessing section 63C in the controller 40 includes an inclination angle computing section 67 in addition to the action determining section 65 and a computation accuracy determining section 66C, and that the computation accuracy determining section 66C has a different functional configuration.

Specifically, the inclination angle computing section 67 computes an inclination angle $\theta s$ which is an angle relative to a reference plane on the basis of acceleration sensed by the IMUs 25, 26, 27, and 28. This computation is nothing but execution of a method which is the same as the first method of angle computation by the IMUs 25, 26, 27, and 28 mentioned above using the gravitational acceleration g as the reference value.

As depicted in FIG. 17, the computation accuracy determining section 66C includes an angular difference computing section 662C instead of the angular-change-amount computing section 662B in the second embodiment. Further, the computation accuracy determining section 66C includes a comparing/determining section 663C that determines the computation accuracy of the IMUs 25, 26, 27, and 28 by a determination method different from the method used by the comparing/determining section 663B in the second embodiment. The computation accuracy determining section 66C does not require the angle threshold conversion table 661B used in the second embodiment, and the comparing/determining section 663C is configured to directly accept input of an acceptable angular error as a computation result of the required-angular-accuracy computing section 62.

The angular difference computing section 662C computes an angular difference $\Delta\theta s$ which is the absolute value of a difference between the angle $\theta$ as a computation result (output value) of the IMUs 25, 26, 27, and 28 and the inclination angle θs as a computation result of the inclination angle computing section 67. The inclination angle θs as a computation result of the inclination angle computing section is the true value of the angle computed by the IMUs 25, 26, 27, and 28 when the machine body 2 and 3 is in a stationary state, and so the angular difference Δθs serves as an index representing whether or not IMU computation accuracy satisfies the required accuracy. The angular difference computing section 662C outputs the computed angular error Δθs to the comparing/determining section 663C.

The comparing/determining section 663C determines whether or not the computation accuracy of the IMUs 25, 26, 27, and 28 satisfies the second required accuracy, by comparing the angular difference Δθs computed by the angular difference computing section 662C with the acceptable angular error as a computation result of the required-angular-accuracy computing section 62. When the angular difference Δθs of the angular difference computing section 662C is greater than the acceptable angular error θa of the required-angular-accuracy computing section 62, the comparing/determining section 663C determines that the accuracy of angle computation by the IMUs 25, 26, 27, and 28 fails to satisfy the second required accuracy, and sets the low-accuracy flag to true. On the other hand, when the angular difference Δθs of the angular difference computing section 662C is equal to or smaller than the acceptable angular error θa of the required-angular-accuracy computing section 62, it is determined that the accuracy of angle computation by the IMUs 25, 26, 27, and 28 satisfies the second required accuracy, and the low-accuracy flag is set to false. This determination is executed only when the action determining section 65 determines that the machine body 2 and 3 is in a stopped state.

Next, an example of a procedure by the IMU-computation-accuracy assessing section according to the third embodiment is explained. Instead of Step S60 (see FIG. 9), which is a process of assessing the accuracy of angle computation by the IMUs 25, 26, 27, and 28 performed by the IMU-computation-accuracy assessing section 63 in the first embodiment, Step S600 depicted in FIG. 18 is executed.

Specifically, the inclination angle computing section 67 in the IMU-computation-accuracy assessing section 63C computes the inclination angle θs based on acceleration sensed by the IMUs 25, 26, 27, and 28 (Step S620C). Next, the angular difference computing section 662C in the computation accuracy determining section 66C in the IMU-computation-accuracy assessing section 63C computes the angular difference Δθs which is the absolute value of the difference between the angle θ as a computation result of the IMUs 25, 26, 27, and 28 and the inclination angle θs as a computation result of the inclination angle computing section 67 (Step S630C), and the procedure proceeds to Step S635.

At Step S635, a determination similar to that at Step S610 in the case of the first embodiment is made. That is, the action determining section 65 determines whether or not the action state of the machine body 2 and 3 is a predetermined stopped state where the accuracy of angle computation by the IMUs has deteriorated. When the action determining section 65 determines that the machine body 2 and 3 is in the predetermined stopped state (YES), the procedure proceeds to Step S640C. On the other hand, when the determination result is NO, the procedure proceeds to Step S660 similarly to the case of the first embodiment.

At Step S640C, it is determined whether or not the angular difference Δθs computed by the angular difference computing section 662C is greater than the acceptable angular error θa of the required-angular-accuracy computing section 62. When the angular difference Δθs is greater than the acceptable angular error θa (in a case of YES) at Step S640C, the procedure proceeds to Step S650, and the comparing/determining section 663C sets the low-accuracy flag to true. On the other hand, when the angular difference Δθs is equal to or smaller than the acceptable angular error θa (in a case of NO), the procedure proceeds to Step S660, and the comparing/determining section 663B sets the low-accuracy flag to false. After the end of Step S650 or Step S660, the process of Step S60C ends.

Next, effects and advantages of the construction machine according to the third embodiment of the present invention are explained by using FIG. 19. In FIG. 19, a thick broken line represents a computation angle θ (output value) of the IMUs, and a solid line represents the inclination angle θs as a computation result of the inclination angle computing section in the IMU-computation-accuracy assessing section.

Since the machine body 2 and 3 vibrates immediately after the time t3 (the time at which a travel operation of the machine body 2 and 3 is stopped), acceleration is generated in various directions. As a result, the inclination angle θs computed by the inclination angle computing section 67 in the IMU-computation-accuracy assessing section 63C in the controller 40 exhibits vibrative behavior. On the other hand, in angle computation by the IMUs 25, 26, 27, and 28 at this time, vibrative behavior of the angle θ as a computation result is inhibited by mainly using sensing results of the angular velocity sensors 32. However, in angle computation by the IMUs 25, 26, 27, and 28, the computation angle θ differs from the true value $\theta_{true}$ undesirably due to effects of smoothing.

Since acceleration due to vibrations are not generated at the time t4 at which machine body vibrations have stopped, the inclination angle θs as a computation result of the inclination angle computing section 67 substantially matches the true value $\theta_{true}$. In contrast, the angle θ as a computation result of the IMUs 25, 26, 27, and 28 has a value different from the true value $\theta_{true}$. Since acceleration due to vibrations is extremely small or acceleration is not generated in the time range from the time ta to the time tb including the time t4, the temporal change of the angle θ as a computation result of the IMUs 25, 26, 27, and 28 temporarily stops.

In the case of the second embodiment mentioned before, from the time ta to the time tb, the angular change amount δθ as a computation result of the angular-change-amount computing section 662B in the computation accuracy determining section 66B in the controller 40 is equal to or smaller than the angle threshold $\theta_{th}$. Hence, the comparing/determining section 663B in the computation accuracy determining section 66B undesirably makes an erroneous determination that the computation accuracy of the IMUs 25, 26, 27, and 28 satisfies the required accuracy.

In contrast, in the third embodiment, from the time ta to the time tb, the angular difference Δθs as a computation result of the angular difference computing section 662C in the computation accuracy determining section 66C is greater than the acceptable angular error θa. Accordingly, the comparing/determining section 663C can correctly determine that the computation accuracy of the IMUs 25, 26, 27, and 28 fails to satisfy the required accuracy. In this manner, the third embodiment can inhibit determination errors that can occur in the second embodiment.

Since the angular difference Δθs is smaller than the acceptable angular error θa at and after a time tc, the comparing/determining section 663C can correctly determine that the computation accuracy of the IMUs 25, 26, 27, and 28 satisfies the required accuracy.

According to the construction machine according to the third embodiment of the present invention mentioned above, similarly to the second embodiment mentioned before, the controller 40 stops operation assistance of the front work implement 1 or gives a warning when the accuracy of angle computation by the IMUs 25, 26, 27, and 28 fails to satisfy the required accuracy even if the machine body 2 and 3 is in a stopped state, and so it is possible to inhibit use of inaccurate postural information during execution of the operation assistance of the front work implement 1.

In addition, in the present embodiment, the required accuracy computation by the controller 40 is to compute the acceptable angular error θa which is a margin of angular error as the second required accuracy. Additionally, the accuracy determination by the controller 40 is made by computing an angle θs relative to the reference plane on the basis of acceleration sensed by the IMUs 25, 26, 27, and 28 (angle measuring apparatus), computing the angular difference Δθs which is the absolute value of the difference between the angle θs computed by the controller 40 and the angle θ computed by the IMUs 25, 26, 27, and 28 (angle measuring apparatus), and comparing the computed angular difference Δθs with the acceptable angular error θa. In the accuracy determination, it is determined that the accuracy of angle computation by the IMUs 25, 26, 27, and 28 (angle measuring apparatus) fails to satisfy the second required accuracy when the computed angular difference Δθs is greater than the acceptable angular error θa.

According to this configuration, as compared to the case of the first embodiment in which the conversion table for setting the comparison subject of accuracy determination about angle computation by the IMUs 25, 26, 27, and 28 (angle measuring apparatus) is specified based on experiment data acquired by using expensive sensors, such a conversion table is unnecessary, and so implementation in the controller 40 does not require a large number of man-hours. Furthermore, since accuracy determination about angle computation by the IMUs 25, 26, 27, and 28 (angle measuring apparatus) is made on the basis of the difference between the angle θ as a computation result of the IMUs 25, 26, 27, and 28 (angle measuring apparatus) and the angle θs computed at the controller 40 on the basis of acceleration as sensing results of the IMUs 25, 26, 27, and 28 (angle measuring apparatus), determination with fewer errors can be made by simple computation even in a case where computation results of the IMUs 25, 26, 27, and 28 (angle measuring apparatus) are of low accuracy and their temporal change amounts do not change temporarily.

Fourth Embodiment

Figure 20:
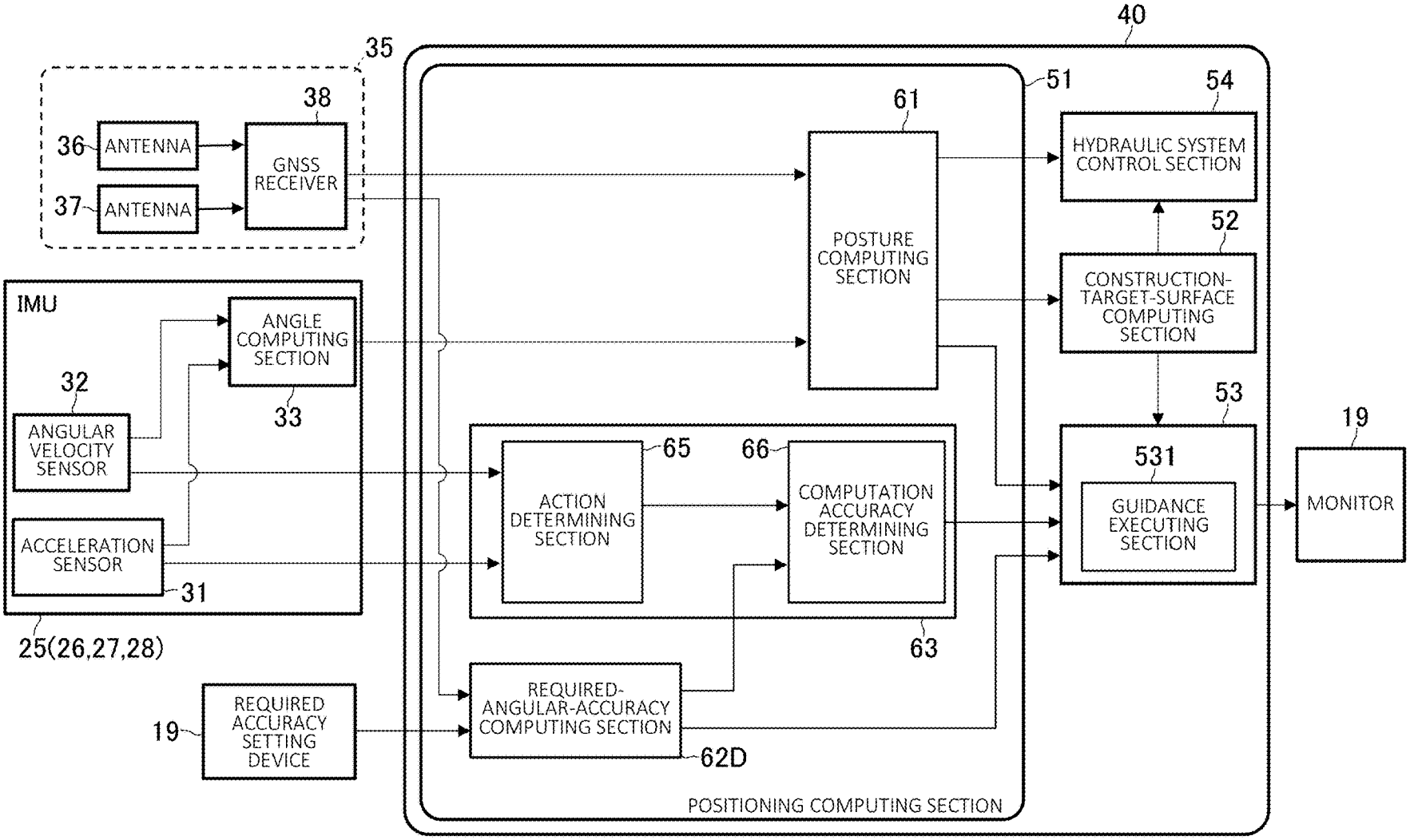
FIG. 20 is a block diagram depicting a functional configuration of a controller in a construction machine according to a fourth embodiment of the present invention.
Figure 21:
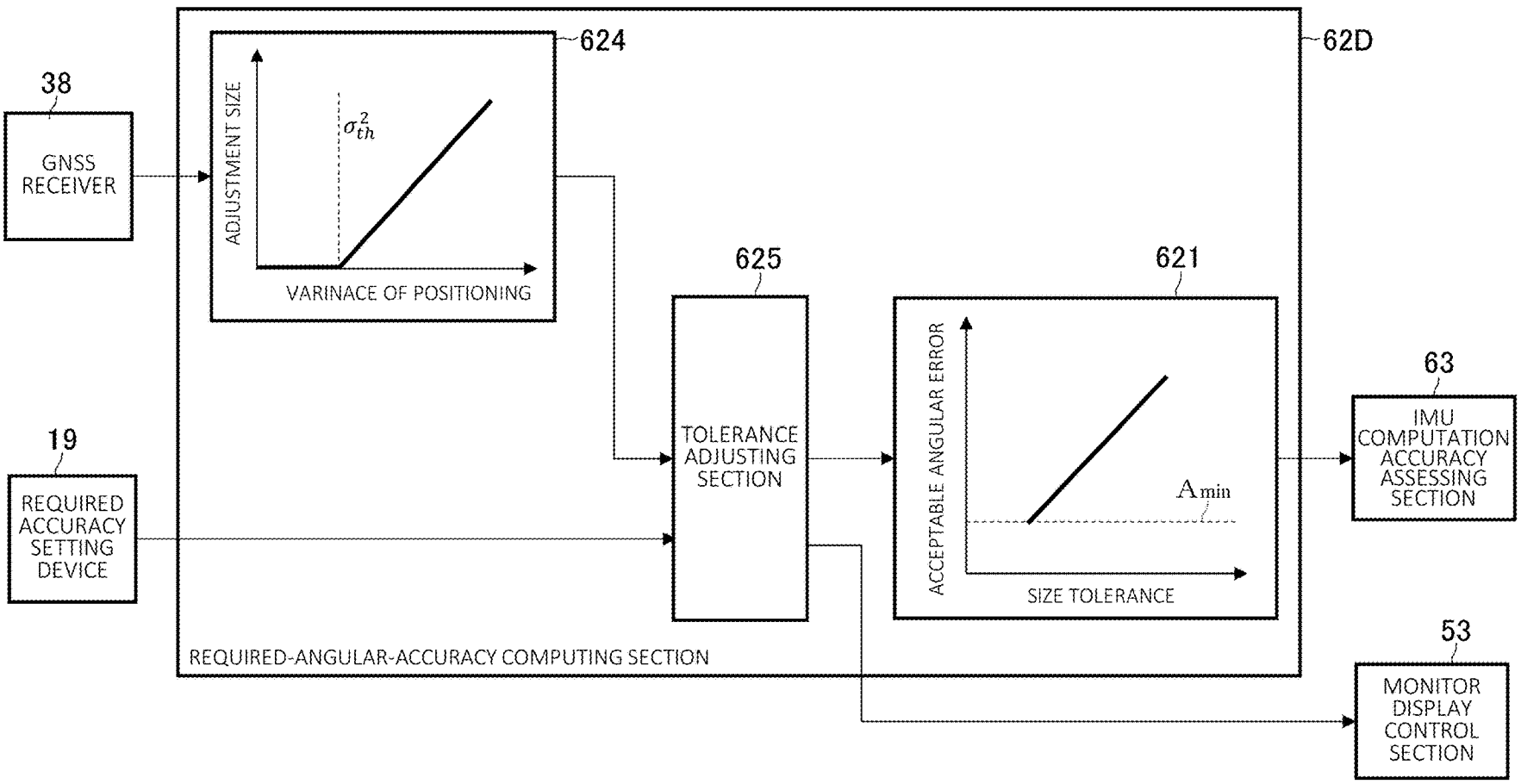
FIG. 21 is a block diagram depicting a functional configuration of a required-angular-accuracy computing section included as part of the positioning computing section in the controller depicted in FIG. 20.

Next, a construction machine according to a fourth embodiment of the present invention is explained by using FIG. 20 to FIG. 21. FIG. 20 is a block diagram depicting a functional configuration of the controller in the construction machine according to the fourth embodiment of the present invention. FIG. 21 is a block diagram depicting a functional configuration of a required-angular-accuracy computing section included as part of the positioning computing section in the controller depicted in FIG. 20. Note that portions in FIG. 20 and FIG. 21 that are given the same reference characters as reference characters of their counterparts depicted in FIG. 1 to FIG. 19 are similar portions, and so detailed explanations thereof are omitted.

The fourth embodiment of the construction machine according to the present invention depicted in FIG. 20 and FIG. 21 is different from the first embodiment in that a computation required-angle computing section 62D in the positioning computing section 51 in the controller 40 has a different functional configuration. The computation required-angle computing section 62 according to the first embodiment (also according to the second and third embodiments) computes the required accuracy (acceptable angular error) for IMU angle computation relative to the required accuracy (a size tolerance as the finishing accuracy) set by the required accuracy setting device 19. However, postural information on the hydraulic excavator provided by machine guidance depends on both positional information from the positioning system 35 and angular information from the IMUs 25, 26, 27, and 28. Accordingly, there is a concern that, even if angles computed by the IMUs are accurate, the postural information provided by the machine guidance becomes inaccurate undesirably in a case where the positional information from the positioning system 35 is inaccurate. From this perspective, the required-angle computing section 62D in the present embodiment sets required accuracy of angle computation by the IMUs 25, 26, 27, and 28, taking into consideration the accuracy of the positional information of the positioning system 35.

Specifically, the required-angular-accuracy computing section 62D includes a configuration that calculates, for the first required accuracy (size tolerance) set by the required accuracy setting device 19, required accuracy that should be compensated in computation by the IMUs 25, 26, 27, and 28, with use of the variance (a value corresponding to a computation error) of positions and speeds from positioning computation by the GNSS receiver 38, in addition to the error conversion table 621 similar to the one in the first embodiment. That is, in a case where an error of positioning computation by the GNSS receiver 38 is significant, the required-angular-accuracy computing section 62D adjusts the required accuracy of angle computation by the IMUs 25, 26, 27, and 28 such that it rises by an amount corresponding to the error.

Even in a case where the positioning system 35 is executing RTK positioning under a favorable reception environment of positioning signals from satellites, a standard deviation (the square root of a variance $\sigma^2$ of positioning computation becomes approximately 2 cm. Accordingly, it is difficult to directly use the standard deviation (the square root of the variance) of positioning computation for required accuracy (size tolerance) of the required accuracy setting device 19. This is because, in a case where required accuracy at finishing work is set to 2 cm, the size accuracy that should be compensated in angle computation by the IMUs 25, 26, 27, and 28 becomes 0 cm if the standard deviation of positioning computation is simply subtracted from the required accuracy of the required accuracy setting device 19, and so this means that errors of angle computation by the IMUs 25, 26, 27, and 28 are not tolerated at all undesirably.

In view of this, the required-angular-accuracy computing section 62D includes a conversion table 624 that is used to convert the variance of positioning computation by the GNSS receiver 38 into an adjustment size. The adjustment size represents the value for adjusting a margin of size error according to errors of positioning computation by the GNSS receiver 38 in angle computation by the IMUs 25, 26, 27, and 28. The conversion table 624 has characteristics that, when the variance of positioning computation is equal to or smaller than a predetermined value $\sigma^2_{th}$, the adjustment size is 0, and when the variance is greater than the predetermined value $\sigma^2_{th}$, the adjustment size increases as the variance increases. That is, if the positioning state of the positioning system 35 is favorable, the adjustment size is set to 0 cm. On the other hand, if the positioning state deteriorates and the variance of positioning computation increases, the adjustment size changes according to the value of the variance.

In addition, the required-angular-accuracy computing section 62D includes a tolerance adjusting section 625 that adjusts required accuracy of angle computation by the IMUs 25, 26, 27, and 28 by subtracting the adjustment size set according to the conversion table 624 from the size tolerance set at the required accuracy setting device 19. The tolerance adjusting section 625 computes a size tolerance which is size accuracy required for angle computation by the IMUs 25, 26, 27, and 28, according to an error of positional information of the GNSS receiver 38. The tolerance adjusting section 625 outputs the size tolerance as a computation result to the conversion table 621. It is supposed that, in a case where the number of satellites that are available for positioning computation by the positioning system 35 changes and the variance of positioning computation becomes equal to or greater than the predetermined value $\sigma^2_{th}$, 1 cm is output as the adjustment size. In a case where the first required accuracy (size tolerance) is set to 2 cm at the required accuracy setting device 19, output of the tolerance adjusting section 625 is 1 cm. In a case where output of the tolerance adjusting section 625 becomes equal to or smaller than 0 cm, the computation accuracy of the IMUs 25, 26, 27, and 28 cannot achieve the required accuracy. In view of this, the tolerance adjusting section 625 can be configured to give a command for execution of warning display to the monitor display control section 53 (guidance executing section 531).

Note that the conversion table 621 is similar to the conversion table in the first embodiment and is used to set an acceptable angular error according to a size tolerance from the tolerance adjusting section 625. The set acceptable angular error is output to the IMU-computation-accuracy assessing section 63.

According to the construction machine according to the fourth embodiment of the present invention mentioned above, similarly to the first embodiment mentioned before, the controller 40 stops operation assistance of the front work implement 1 or gives a warning when the accuracy of angle computation by the IMUs 25, 26, 27, and 28 fails to satisfy the required accuracy even if the machine body 2 and 3 is in a stopped state, and so it is possible to inhibit use of inaccurate postural information during execution of the operation assistance of the front work implement 1.

In addition, the hydraulic excavator (construction machine) according to the present embodiment further includes the GNSS antennas 36 and 37 (receiver) that are attached to the machine body 2 and 3 and receive positioning signals from a plurality of satellites, and the GNSS receiver 38 (positioning computing device) that computes the position of the machine body 2 and 3 and the variance of the position of the machine body 2 and 3 on the basis of the positioning signals from the plurality of satellites received by the GNSS antennas 36 and 37 (receivers). Further, the required accuracy computation by the controller 40 is to, in a case where accuracy in size is set as the first required accuracy, set an adjustment size from the variance of the position of the machine body 2 and 3 computed by the GNSS receiver 38 (positioning computing device), with use of the conversion table 624 specified in advance such that the adjustment size increases as the variance of the position of the machine body 2 and 3 increases when the variance of the position of the machine body 2 and 3 is greater than the predetermined value $\sigma^2_{th}$, perform size tolerance computation of computing a size tolerance which is size accuracy required for the angle computation by the IMUs 25, 26, 27, and 28 (angle measuring apparatus) by subtracting the set adjustment size from the first required accuracy, and compute the second required accuracy from the size tolerance computed by the size tolerance computation, with use of the conversion table 621 specified in advance such that the second required accuracy lowers as the size tolerance increases.

According to this configuration, for the first required accuracy set for operation assistance, the second required accuracy is set on the basis of a result obtained by subtracting the adjustment size set according to the variance of the position as a computation result of the GNSS receiver 38 (positioning computing device), and so the level of required accuracy for angle computation by the IMUs 25, 26, 27, and 28 (angle measuring apparatus) can be adjusted according to the value of a computation error of positional information of the GNSS receiver 38 (positioning computing device). When the positional information of the GNSS receiver 38 (positioning computing device) is of low accuracy, use of inaccurate postural information can further be inhibited during execution of operation assistance by making the required accuracy of angle computation by the IMUs 25, 26, 27, and 28 (angle measuring apparatus) stricter.

Fifth Embodiment

Figure 22:
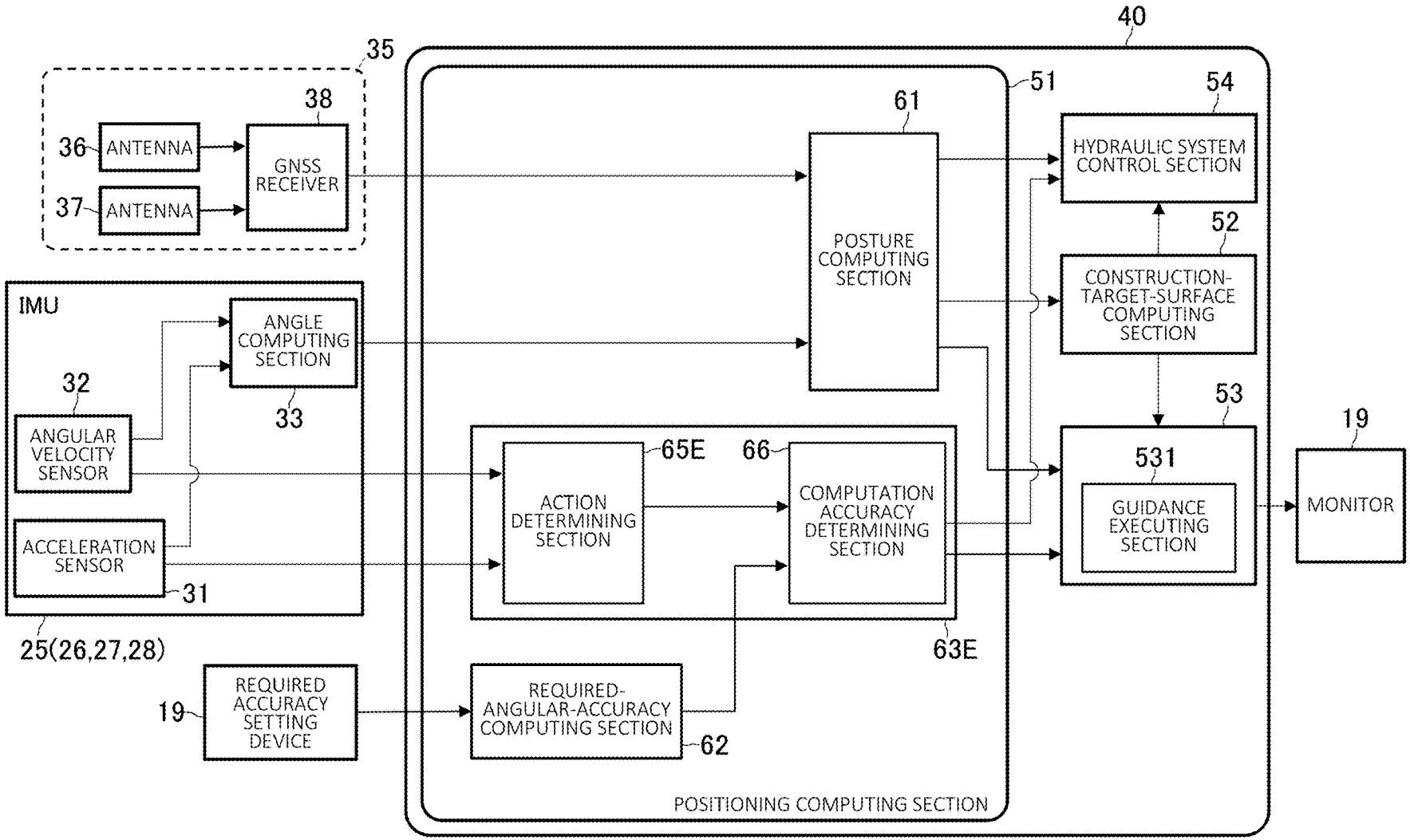
FIG. 22 is a block diagram depicting a functional configuration of a controller in a construction machine according to a fifth embodiment of the present invention.

Next, a construction machine according to a fifth embodiment of the present invention is explained by using FIG. 3 and FIG. 22. FIG. 22 is a block diagram depicting a functional configuration of the controller in the construction machine according to the fifth embodiment of the present invention. Note that portions in FIG. 22 that are given the same reference characters as reference characters of their counterparts depicted in FIG. 1 to FIG. 21 are similar portions, and so detailed explanations thereof are omitted.

The construction machine according to the fifth embodiment of the present invention depicted in FIG. 22 is different from that of the second embodiment in that a result of a determination about computation accuracy by an IMU-computation-accuracy assessing section 63E in the positioning computing section 51 in the controller 40 is output to the hydraulic system control section 54, and that control by the hydraulic system control section 54 is changed according to the result of the determination about the computation accuracy.

As depicted in the bottom diagram in FIG. 3, errors of angles computed by the IMUs are not significant immediately after a traveling action or a swinging action of the machine body is started (immediately after the time t1). However, if the action is continued, errors of the computation angles gradually increase due to the influence of sensor biases of the IMUs. By contrast, if the action is not continued, computation accuracy of the IMUs does not deviate from the required accuracy, and so it is possible to continue work.

In view of this, in the present embodiment, if the computation accuracy of the IMUs 25, 26, 27, and 28 deviates from the required accuracy due to a traveling action or a swinging action of the machine body 2 and 3, the traveling action or the swinging action which is a factor of deterioration of the computation accuracy of the IMUs 25, 26, 27, and 28 is stopped immediately. Specifically, in a case where an action determining section 65E in the IMU-computation-accuracy assessing section 63E determines that a traveling or swinging action is continued for a certain predetermined period or longer, when the IMU-computation-accuracy assessing section 63E assesses that the accuracy of angle computation by the IMUs 25, 26, 27, and 28 fails to satisfy required accuracy, the hydraulic system control section 54 in the controller 40 controls the hydraulic system such that the action is stopped. The determination by the action determining section 65E is basically possible by executing the process of Step S50 (Steps S510 to S570) in the flowchart depicted in FIG. 8, for example. It should be noted that the action determining section 65E may be configured to determine whether or not the state where the travel flag has been set to true has continued for a predetermined period or longer during continuation of control cycles, and also determine whether or not the state where the swing flag has been set to true has continued for a predetermined period or longer, at Step S570. By performing an OR operation on the determination as to whether or not the state where the travel flag has been set to true has continued and the determination as to whether or not the state where the swing flag has been set to true has continued, the action determining section 65E integrates, into one signal, information representing that an active state of the machine body 2 and 3 has continued for a predetermined period or longer.

Note that, if traveling and swinging actions are stopped automatically, there can be a situation where operation by an operator and an action of the hydraulic excavator do not match. Accordingly, in a desirable manner of configuration, this control can be shifted between execution and cancellation at any timing by a tablet terminal or the like.

The construction machine according to the fifth embodiment of the present invention mentioned above can attain advantages similar to those of the second embodiment mentioned before.

In addition, the controller 40 according to the present embodiment is further configured to make an action continuation determination of determining whether or not an active state of the machine body 2 and 3 has continued for a predetermined period or longer on the basis of sensing results of the IMUs 25, 26, 27, and 28 (angle measuring apparatus), and stop an action of the machine body 2 and 3 in a case where it is determined that the active state of the machine body 2 and 3 has continued for the predetermined period or longer, and besides, where it is determined that the accuracy of angle computation by the IMUs 25, 26, 27, and 28 (angle measuring apparatus) fails to satisfy the second required accuracy.

According to this configuration, by stopping an action which is a factor of deterioration of the computation accuracy of the IMUs 25, 26, 27, and 28 (angle measuring apparatus) before errors of angle computation by the IMUs 25, 26, 27, and 28 (angle measuring apparatus) increase, it is possible to resume execution of machine guidance using accurate postural information.

Sixth Embodiment

Figure 23:
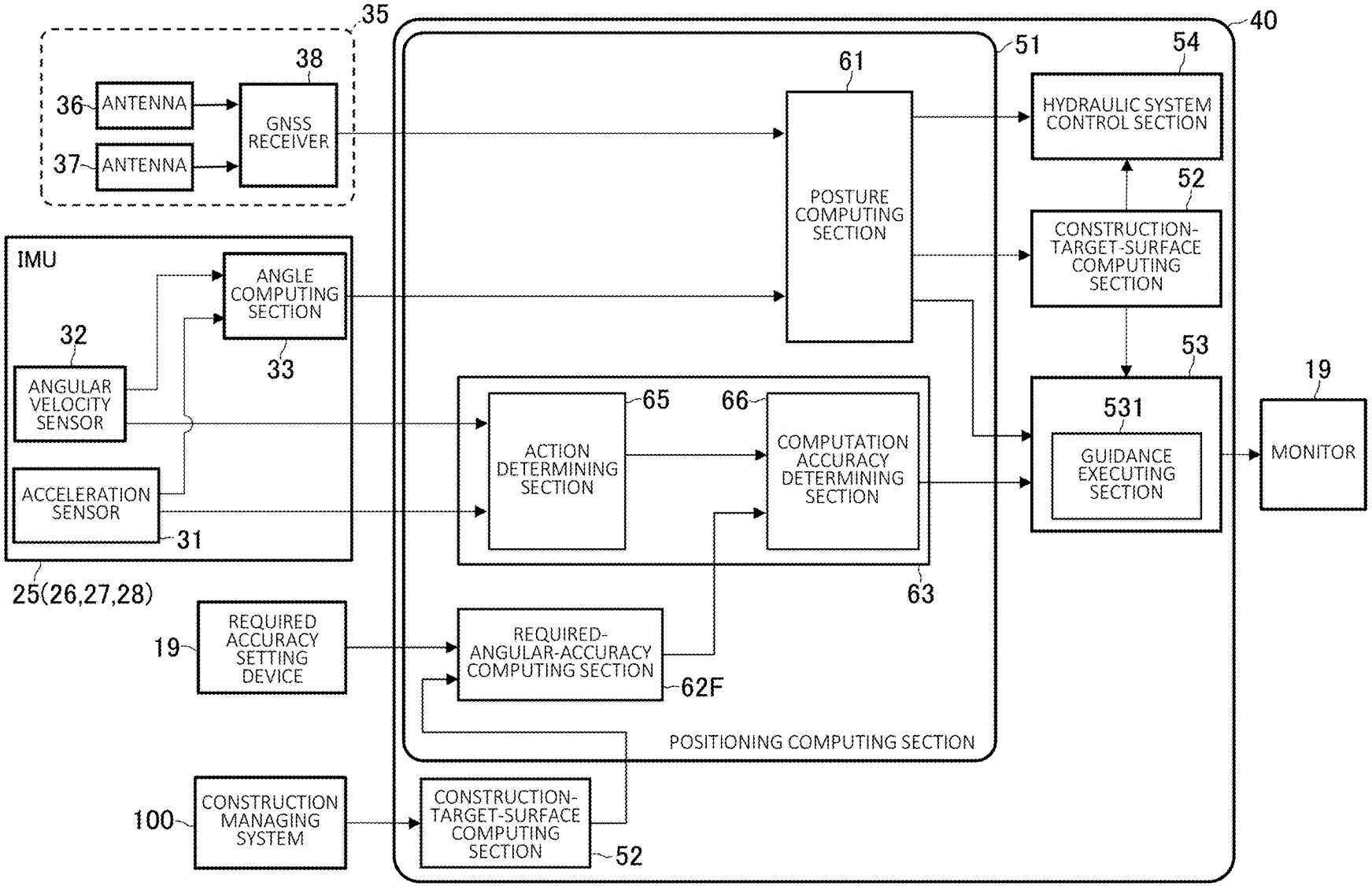
FIG. 23 is a block diagram depicting a functional configuration of a controller in a construction machine according to a sixth embodiment of the present invention.

Next, a construction machine according to a sixth embodiment of the present invention is explained by using FIG. 23. FIG. 23 is a block diagram depicting a functional configuration of the controller in the construction machine according to the sixth embodiment of the present invention. Note that portions in FIG. 23 that are given the same reference characters as reference characters of their counterparts depicted in FIG. 1 to FIG. 22 are similar portions, and so detailed explanations thereof are omitted.

The construction machine according to the sixth embodiment of the present invention depicted in FIG. 23 is different from that of the first embodiment in that a required-angular-accuracy computing section 62F in the positioning computing section 51 in the controller 40 computes an acceptable angular error as the second required accuracy on the basis of construction information managed at a construction managing system 100. For example, the construction managing system 100 is a cloud system that manages the state of progress of construction of a site such as construction information. As design information, the construction information includes size tolerances which are required accuracy in size.

The required-angular-accuracy computing section 62F executes, in a case where there is no input from the required accuracy setting device 19, computation of angular accuracy required for angle computation by the IMUs 25, 26, 27, and 28 on the basis of the required accuracy included in the construction information input from the construction managing system 100 to construction-target-surface computation. The controller 40 can be configured to change the required accuracy (first required accuracy) included in the construction information depending on the progress situation of construction managed by the construction managing system 100. For example, as there is an advancement in the state of progress of the construction managed by the construction managing system 100, the size tolerance as the design information is changed in such a manner that it is reduced (the required accuracy is raised). For example, since there is earth and sand up to the height of several dozen centimeters from an excavation target surface immediately after the start of construction, a setting value for rough excavation (e.g., 10 cm) is set automatically, and the setting value switches to a setting value for finishing excavation (e.g., 2 cm) gradually as there is an advancement in the construction.

In the configurations according to the first to fifth embodiments, the first required accuracy (size tolerance) is set via the required accuracy setting device 19 by operation of an operator. Since such configurations make it necessary for the operator to change the required accuracy according to operation such as rough excavation or finishing excavation, operation of the operator becomes complicated.

In contrast, in the present embodiment, the controller 40 is configured to take in, from the construction managing system 100 that manages the state of progress of construction at a site, as the first required accuracy, required accuracy included in construction information managed at the construction managing system 100, and raise the first required accuracy as there is an advancement in the state of progress of the construction managed by the construction managing system 100.

According to this configuration, the first required accuracy is set independently of operation by an operator, and so labor of operation by the operator can be reduced. In addition, since the controller 40 automatically changes the first required accuracy depending on the progress situation of construction, the operator is not required to reset the required accuracy in size according to operation such as rough excavation or finishing excavation, and labor of operation by the operator can be reduced.

The construction machine according to the sixth embodiment of the present invention mentioned above can attain advantages similar to those of the first embodiment mentioned before.

Other Embodiments

Note that, whereas the present invention is applied to a hydraulic excavator in examples depicted in the embodiments mentioned above, the present invention can be applied widely to various types of construction machines that perform control on the basis of angular information which is computation results of IMUs.

In addition, the present invention is not limited to the present embodiments and includes various modification examples. The embodiments described above are explained in detail for explaining the present invention in an easy-to-understand manner, and the present invention is not necessarily limited to those including all constituent elements explained. It is possible to replace some of constituent elements of an embodiment with constituent elements of another embodiment, and it is also possible to add constituent elements of an embodiment to the constituent elements of another embodiment. In addition, some of constituent elements of each embodiment can also have other constituent elements additionally, be deleted, or be replaced.

DESCRIPTION OF REFERENCE CHARACTERS

1: Front work implement (work implement)
2: Lower track structure (machine body)
3: Upper swing structure (machine body)
19: Monitor (display device)
25: Machine-body IMU (angle measuring apparatus)
26: Boom IMU (angle measuring apparatus)
27: Arm IMU (angle measuring apparatus)
28: Bucket IMU (angle measuring apparatus)
36, 37: GNSS antenna (receiver)
38: GNSS receiver (positioning computing device)
40: Controller
100: Construction managing system
621: Error conversion table (conversion table)
624: Conversion table
661: Time conversion table (conversion table)
661B: Angle threshold conversion table (conversion table)

The invention claimed is:

1. A construction machine comprising:
a machine body;
a work implement attached pivotably to the machine body;
an angle measuring apparatus installed on the machine body and the work implement, the angle measuring apparatus being configured to sense acceleration and an angular velocity of an installation portion and perform angle computation of computing an angle of the installation portion relative to a reference plane on a basis of sensing results; and
a controller configured to compute postural information representing postures of the machine body and the work implement on a basis of the angle computed by the angle measuring apparatus, cause a display device to display the computed postural information, and execute operation assistance of the work implement on a basis of the computed postural information, wherein
the controller is configured to
perform required accuracy computation on a basis of first required accuracy that is required accuracy set for information used for the operation assistance of the work implement, the required accuracy computation being to compute second required accuracy that is accuracy required for the angle computation by the angle measuring apparatus,
make an action stop determination of determining whether or not a state of the machine body has changed from an active state to a stopped state, on a basis of the sensing results of the angle measuring apparatus,
make an accuracy determination of determining whether or not accuracy of the angle computation by the angle measuring apparatus satisfies the second required accuracy, and
stop the operation assistance of the work implement or give a warning in a case where it is determined that the state of the machine body has changed from an active state to a stopped state, and where it is determined that the accuracy of the angle computation by the angle measuring apparatus fails to satisfy the second required accuracy.

2. The construction machine according to claim 1, wherein
the accuracy determination by the controller is made by
using a conversion table to set a time threshold from the second required accuracy computed by the required accuracy computation, the conversion table being specified in advance such that the time threshold increases as the second required accuracy rises,
counting elapsed time since a time at which it is determined in the action stop determination that the state of the machine body has changed from an active state to a stopped state, and
comparing the counted elapsed time with the set time threshold, and
it is determined in the accuracy determination that the accuracy of the angle computation by the angle measuring apparatus fails to satisfy the second required accuracy, when the counted elapsed time is shorter than the set time threshold.

3. The construction machine according to claim 1, wherein the accuracy determination by the controller is made by
using a conversion table to set an angle threshold from the second required accuracy computed by the required accuracy computation, the conversion table being specified in advance such that the angle threshold decreases as the second required accuracy rises,
computing a temporal change amount of the angle computed by the angle measuring apparatus, and
comparing the computed temporal change amount of the angle with the set angle threshold, and
it is determined in the accuracy determination that the accuracy of the angle computation by the angle measuring apparatus fails to satisfy the second required accuracy, when the computed temporal change amount of the angle is greater than the set angle threshold.

4. The construction machine according to claim 1, wherein the required accuracy computation by the controller is to compute an acceptable angular error that is a margin of angular error as the second required accuracy,
the accuracy determination by the controller is made by
computing an angle relative to the reference plane on a basis of the acceleration sensed by the angle measuring apparatus,
computing an angular difference that is an absolute value of a difference between the angle computed by the controller and the angle computed by the angle measuring apparatus, and
comparing the computed angular difference with the acceptable angular error, and
it is determined in the accuracy determination that the accuracy of the angle computation by the angle measuring apparatus fails to satisfy the second required accuracy, when the computed angular difference is greater than the acceptable angular error.

5. The construction machine according to claim 1, further comprising:

a receiver that is attached to the machine body and receives positioning signals from a plurality of satellites; and a positioning computing device configured to compute a position of the machine body and a variance of the position of the machine body on a basis of the positioning signals from the plurality of satellites received by the receiver, wherein, the required accuracy computation by the controller is to, in a case where accuracy in size is set as the first required accuracy, use a conversion table to set an adjustment size from the variance of the position of the machine body computed by the positioning computing device, the conversion table being specified in advance such that the adjustment size increases as the variance of the position of the machine body increases in a case where the variance of the position of the machine body is greater than a predetermined value, perform size tolerance computation of computing a size tolerance that is size accuracy required for the angle computation by the angle measuring apparatus by subtracting the set adjustment size from the first required accuracy, and use a conversion table to compute the second required accuracy from the size tolerance computed by the size tolerance computation, the conversion table being specified in advance such that the second required accuracy lowers as the size tolerance increases.

6. The construction machine according to claim 1, wherein the controller is further configured to make an action continuation determination of determining whether or not an active state of the machine body has continued for a predetermined period or longer on a basis of the sensing results of the angle measuring apparatus, and stop an action of the machine body in a case where it is determined that the active state of the machine body has continued for the predetermined period or longer, and where it is determined that the accuracy of the angle computation by the angle measuring apparatus fails to satisfy the second required accuracy.

7. The construction machine according to claim 1, wherein the controller is configured to take in, from a construction managing system that manages progress of construction at a site, as the first required accuracy, required accuracy included in construction information managed at the construction managing system, and raise the first required accuracy as there is an advancement in the progress of the construction managed by the construction managing system.

* * * * *